US010513050B2

(12) United States Patent
Kaneider et al.

(10) Patent No.: US 10,513,050 B2
(45) Date of Patent: Dec. 24, 2019

(54) METHOD FOR CONTROLLING A WALL SAW SYSTEM DURING THE CREATION OF A SEPARATION CUT

(71) Applicant: Hilti Aktiengesellschaft, Schaan (LI)

(72) Inventors: Wilfried Kaneider, Rankweil (AT); Dragan Stevic, Feldkirch-Tosters (AT); Christian Bereuter, Lingenau (AT); Peter Hricko, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 208 days.

(21) Appl. No.: 15/509,414

(22) PCT Filed: Sep. 1, 2015

(86) PCT No.: PCT/EP2015/069926
§ 371 (c)(1),
(2) Date: Mar. 7, 2017

(87) PCT Pub. No.: WO2016/037896
PCT Pub. Date: Mar. 17, 2016

(65) Prior Publication Data

US 2017/0297225 A1 Oct. 19, 2017

(30) Foreign Application Priority Data

Sep. 8, 2014 (EP) ..... 14003103

(51) Int. Cl.
*B28D 7/00* (2006.01)
*B28D 1/10* (2006.01)
*B28D 1/04* (2006.01)

(52) U.S. Cl.
CPC ..... *B28D 7/005* (2013.01); *B28D 1/044* (2013.01); *B28D 1/10* (2013.01)

(58) Field of Classification Search
CPC ..... B28D 1/042; B28D 1/044; B28D 1/045; B26D 1/10; B26D 7/005; B23D 59/002;
(Continued)

(56) References Cited

U.S. PATENT DOCUMENTS 5,241,946 A * 9/1993 Yelton ..... B25G 1/04 125/13.01
7,337,037 B2 * 2/2008 Schaer ..... B23D 59/002 125/13.01
(Continued)

FOREIGN PATENT DOCUMENTS

DE 10 2005 000 013 A1 8/2006
DE 10 2011 089 878 A1 6/2013
(Continued)

OTHER PUBLICATIONS

PCT/EP2015/069926, International Search Report dated Nov. 5, 2015, with partial English translation (Seven (7) pages).
(Continued)

*Primary Examiner* — Ghassen Alie
(74) *Attorney, Agent, or Firm* — Crowell & Moring LLP

(57) ABSTRACT

A method for controlling a wall saw system during the creation of a separating cut in a workpiece. The movement of the saw head is controlled at the end points such that a boundary of the wall saw facing the end point coincides with the end point after the pivoting movement of the saw arm. In the case of a free end point, the boundary of the wall saw is formed by an upper exit point of the saw blade. In the case of an obstacle, the boundary of the wall saw is formed by the saw blade edge of the saw blade if the processing occurs without the blade guard or by the blade guard edge of the blade guard if the processing occurs with the blade guard.

20 Claims, 9 Drawing Sheets

(58) Field of Classification Search
CPC ..... B23D 59/008; Y10T 83/04; Y10T 83/541; Y10T 83/7755; Y10T 83/05; Y10T 83/8773; Y10T 83/7697
USPC ..... 83/39, 13, 74–76, 34, 471.3, 473, 490, 83/169, 520, 663, 483, 581, 578; 700/160, 159, 170, 191, 192, 193
See application file for complete search history.

(56) References Cited

U.S. PATENT DOCUMENTS

| | | | | |
|---|---|---|---|---|
| 9,089,994 | B2 * | 7/2015 | Flock | B28D 1/044 |
| 2006/0189258 | A1 | 8/2006 | Schaer et al. | |
| 2008/0276773 | A1 * | 11/2008 | Togare | B23D 45/024 83/34 |
| 2011/0056716 | A1 * | 3/2011 | Jonsson | B23D 47/08 173/217 |
| 2011/0203564 | A1 * | 8/2011 | Werder | B28D 1/044 125/13.01 |
| 2012/0234305 | A1 | 9/2012 | Jönsson | |
| 2013/0180371 | A1 * | 7/2013 | Flock | B28D 1/044 83/13 |

FOREIGN PATENT DOCUMENTS

| | | | |
|---|---|---|---|
| DE | 10 2013 202 442 | A1 | 8/2014 |
| DE | 10 2013 202 445 | A1 | 8/2014 |
| DE | 10 2013 202 754 | A1 | 8/2014 |
| EP | 1 693 173 | B1 | 8/2006 |
| JP | 2006-231920 | A | 9/2006 |
| JP | 2016-507390 | A | 3/2016 |
| JP | 2016-507392 | A | 3/2016 |
| WO | WO 2014/124912 | A1 | 8/2014 |
| WO | WO 2014/128095 | A1 | 8/2014 |

OTHER PUBLICATIONS

European Search Report issued in European counterpart application No. 14003103.0-1709 dated Apr. 30, 2015, with Statement of Relevancy (Seven (7) pages).

U.S. Patent Application, "Method for Controlling a Wall Saw System When Making a Separating Cut", filed Mar. 7, 2017, Inventor Wilfried Kaneider et al.

U.S. Patent Application, "Method for Controlling a Wall Saw System During the Creation of a Separation Cut", filed Mar. 7, 2017, Inventor Wilfried Kaneider et al.

U.S. Patent Application, "Method for Controlling a Wall Saw System During the Creation of a Separating Cut", filed Mar. 7, 2017, Inventor Wilfried Kaneider et al.

Japanese Notice of Reasons for Refusal issued in Japanese counterpart application No. 2017-513088 dated Mar. 28, 2018 (Four (4) pages).

A Guide for a Scheme of Execution "A Wall Sawing Method", Japan, General Corporate Judicial Person Japan Concrete Sawing & Drilling Association, Jul. 1, 2011, 12$^{th}$ Edition (28 total pages).

* cited by examiner

METHOD FOR CONTROLLING A WALL SAW SYSTEM DURING THE CREATION OF A SEPARATION CUT

This application claims the priority of International Application No. PCT/EP2015/089928, filed Sep. 1, 2015, and European Patent Document No. 14003103.0, filed Sep. 8, 2014, the disclosures of which are expressly incorporated by reference herein.

BACKGROUND AND SUMMARY OF THE INVENTION

The present invention relates to a method for controlling a wall saw system during the creation of a separation cut.

A method is known from EP 1 893 173 B1 for controlling a wall saw system during the creation of a separation cut in a workpiece between a first end point and a second end point. The wall saw system comprises a guide rail and a wall saw with a saw head, a motor-driven feed unit that moves the saw head parallel to a feed direction along the guide rail, and at least one saw blade attached to a saw arm of the saw head and driven by a drive motor about an axis of rotation. The saw arm is pivotable by means of a pivoting motor about a pivot axis. By a pivoting movement of the saw arm about the pivot axis, the penetration depth is changed in the workpiece. The motor-driven feed unit comprises a guide carriage and a feed motor, wherein the saw head is mounted on the guide carriage and moved via the feeding motor along the guide rail. To monitor the wall saw system a sensor device is provided with a pivot angle sensor and a displacement sensor. The pivot angle sensor measures the present pivot angle of the saw arm and the displacement sensor measures the actual position of the saw head on the guide rail. The measured values for the current pivot angle of the saw arm and the actual position of the saw head are regularly sent to a control unit of the wall saw.

The known method for controlling a wall saw system is divided into a preparation part and processing of the separation cut. In the preparation part the operator sets at least the saw blade diameter of the saw blade, the positions of the first and second end point in the feed direction and the final depth of the separation cut; other parameters can be the material of the workpiece to be machined and the dimensions of embedded rebar. From the parameters entered, the control unit determines an appropriate main cutting sequence of main cuts for the separation cut, wherein the main cutting sequence comprises at least a first main cut having a first main cutting angle of the saw arm and a first diameter of the saw blade used, and a following second main cut with a second main cutting angle of the saw arm and a first diameter of the saw blade used.

After starting the controlled processing the saw head is positioned in a starting position. In the starting position the saw arm is pivoted in a negative direction of rotation about the pivot axis and arranged below the first main negative cutting angle. The saw head is moved in a positive feed direction along the guide rail in the direction of the second end point, wherein the saw arm during the processing is in a pulling arrangement. Before reaching the second end point the saw head is stopped and reset far enough in a negative feed direction contrary to the positive feed direction. The saw arm is pivoted in a positive direction of rotation opposite to the negative direction of rotation from the negative first main cutting angle in a positive main cutting angle of the saw arm.

In a first variant the saw arm is pivoted from the negative first main cutting angle to the positive first main cutting angle and the saw head is moved in the positive feed direction to the second end point, wherein the saw arm is in an abutting arrangement. Upon reaching the second end point the feed direction is reversed and the saw head is moved in the negative feed direction to the first end point, wherein the saw arm is in a pulling arrangement. Prior to the first end point the saw head is stopped and reset sufficiently far in the positive feed direction. The saw arm is pivoted from the positive first main cutting angle in the negative first main cutting angle and the saw head is moved in the negative feed direction to the first end point, wherein the saw arm is in an abutting arrangement.

In a second variant the saw arm is pivoted from the negative first main cutting angle to the positive second main cutting angle and the saw head is moved from the positive feed direction to the second end point, wherein the saw arm is in an abutting arrangement. Upon reaching the second end point the feed direction is reversed and the saw head is moved in the negative feed direction to the first end point, wherein the saw arm is in a pulling arrangement. Before the first end point the saw head is stopped and set far enough hack in the positive feed direction. The saw arm is pivoted from the negative second main cutting angle and the saw head is moved in the negative feed direction to the first end point, wherein the saw head is in an abutting arrangement. If the second main cut is the last main cut, the saw arm is pivoted in the positive second main cut angle. If a third main cut is performed with the third main cut angle, the saw arm is pivoted from the negative second main cutting angle to the positive third main cutting angle of the third main cut. The method steps are repeated until the final depth of the separation cut is reached.

The known method for controlling a wall saw system has the disadvantage that the saw head before the processing is reset in an abutting arrangement of the saw arm. In the resetting there is only a positioning of the saw head and no processing of the workpiece. The time required for the positioning above all extends the nonproductive time given short cuts.

The object of the present invention is to develop a method for controlling a wall saw system with a high processing quality in which the nonproductive times for positioning the saw head and saw arm are reduced.

This object in the method for controlling a wall saw system is solved according to the invention by the features of the independent claim. Advantageous developments are indicated in the dependent claims.

The invention provides that the saw head in the controlled processing is moved such that after the pivoting movement of the saw arm to the new pivot angle a second limit of the wall saw facing the second end point coincides with the second end point, wherein the second limit of the wall saw is formed by a second upper exit point of the saw blade used facing the second end point on an upper side of the workpiece if the second end point is a free end point without barrier, by a second saw blade edge of the saw blade used facing the second end point, if the second end point is a barrier and the processing occurs without a blade guard, and by a second blade edge of the blade guard used facing the second end point if the second end point is a barrier and the processing occurs with a blade guard.

The inventive method for controlling a wall saw system has the advantage that a processing with an exclusively pulling saw arm is possible and nonproductive times for positioning the saw are reduced by a corresponding position control of the saw head. The second limit of the wall saw is used for controlling the method in the transition from the first main cut to the second main cut. The second limit is formed with a free end point without barrier by the second upper exit point of the saw blade used and with a barrier by the second saw blade edge (without blade guard) and the second blade guard edge (with blade guard).

Additionally preferred before the start of the processing controlled by the control unit is a length of the saw arm that is defined as the distance between the pivot axis of the saw arm and the axis of rotation of the saw blade, and that determines the distance between the pivot axis and the upper side of the workpiece. For a controlled processing of the separation cut, various parameters must be known to the control unit. These include the saw arm length, which represents a first device-specific size of the wall saw, and the vertical distance between the pivot axis and the surface of the workpiece, which besides the geometry of the wall saw also depends on the geometry of the guide rail used.

Additionally particularly preferred before the start of the controlled processing is a first width established for a blade guard used in the first main cut and a second width for a blade guard used in the second main cut, wherein the first and second widths are each comprised of a first distance of the pivot axis to the first blade guard edge and a second distance of the pivot axis to the second blade guard edge. If an end point represents a barrier, the position control of the saw head occurs through the blade guard edge facing the barrier of the blade guard used. With an asymmetrical blade guard, the first and second distances of the pivot axis to the blade guard edges are different, whereas with a symmetrical blade guard the first and second distances of the blade guard edges match the half-width of the blade guard.

The inventive control method is characterized in that the second limit of the wall saw after the pivoting movement of the saw arm to the new pivot angle coincides with the second end point. The new pivot angle in a first development corresponds to the first main cut angle of the first main cut and in a second development corresponds to the second main cut angle of the second main cut.

In the first development the saw arm is pivoted in the positive rotational direction from the negative first main cut angle into the positive first main cut angle and after the pivoting movement into the positive first main cut angle the second upper exit point of the saw blade used corresponds with the second end point if the pivot axis has a distance to the second end point of $\sqrt{[h_1(D_1-h_1)]}+\delta \sin(+\alpha_1)$, where $h=h(+\alpha_1, D_1)=D_1/2-\Delta-\delta \cos(+\alpha_1)$ designates the penetration depth of the saw blade used into the workpiece with the positive first main cut angle with the first diameter, the edge of the saw blade used corresponds with the second end point if the pivot axis has a distance to the second end point of $D_1/2+\delta \sin(+\alpha_1)$, and the second edge of the blade guard used coincides with the second end point if the pivot axis has a distance to the second end point of $B_{1b}+\delta \sin(+\alpha_1)$.

In the inventive method the saw arm is arranged exclusively pulling and the saw arm is pivoted in a position such that after the pivoting the second limit of the wall saw coincides with the second end point. Because of the pivot, residual material remains in the area of the pivot axis. The residual material of the first main cut in a first variant is completely removed in the first main cut and in a second variant is partly removed in the first main cut.

In the first variant the saw head is moved in a negative feed direction directed counter to the positive feed direction by a path length of at least $2\delta|\sin(+\alpha_1)|$ and the saw head is then positioned such that the second limit of the wall saw after the pivoting movement of the saw arm in the positive second main cut angle coincides with the second end point, wherein the second upper exit point coincides with the second end point if the pivot axis has a distance to the second end point of $\sqrt{[h_2(D_2-h_2)]}+\delta \sin(+\alpha_2)$, where $h_2=h(+\alpha_2, D_2)=D_2/2-\Delta-\delta \cos(+\alpha_2)$ designates the penetration depth of the saw blade used into the workpiece with the positive second main cut angle with the second diameter, the second edge of the saw blade used corresponds with the second end point if the pivot axis has a distance to the second end point of $D_2/2+\delta \sin(+\alpha_2)$, and the second edge of the blade guard used coincides with the second end point if the pivot axis has a distance to the second end point of $B_{2b}+\delta \sin(+\alpha_2)$.

The first variant is identified as complete removal of the residual material. The path length is set such that the remaining material not removed by the pivoting of the saw arm is completely covered. After the removal of the residual material the saw head is positioned for the second main cut, wherein with a free end point without barrier the second upper exit point is used, with barrier the second saw blade edge with the second blade guard edge, depending on whether the processing occurs with or without blade guard. The first variant has the advantage that the residual material is fully removed in the first main cut and in the second main cut only the depth of cut of the second main cut must be removed. Consequently, the first variant is suitable for lower-power drive motors.

In the second variant the saw head is moved in the negative feed direction such that the second limit of the wall saw after the pivoting movement of the saw arm in the positive second main cut angle coincides with the second end point, wherein the second upper exit point of the saw blade used coincides with the second end point if the pivot axis has a distance to the second end point of $\sqrt{[h_2(D_2-h_2)]}+\delta \sin(+\alpha_2)$, where $h_2=h(+\alpha_2, D_2)=D_2/2-\Delta-\delta \cos(+\alpha_2)$ designates the penetration depth of the saw blade used into the workpiece with the positive second main cut angle with the second diameter, the second edge of the saw blade used coincides with the second end point if the pivot axis has a distance to the second end point of $D_2/2+\delta \sin(+\alpha_2)$, and the second edge of the blade guard used coincides with the second end point if the pivot axis has a distance to the second end point of $B_{2b}+\delta \sin(+\alpha_2)$.

The second variant is identified as partial removal of the residual material. The removal of the residual material and the positioning of the saw head for the second main cut are combined. After the pivoting of the saw arm in the positive first main cut angle the saw head is moved until the pivot axis has a defined distance to the second end point $E_2$. The distance depends on whether the end point represents a free end point without barrier or, if the end point has a barrier, the processing occurs with or without blade guard. The distance is set such that the second limit of the wall saw after the pivoting movement in the positive second main cut angle coincides with the second end point $E_2$. The second variant has the advantage that the removal of the residual material and positioning for the second main cut are combined and the additional positioning step is eliminated; on the other hand, in the second main cut a greater depth of cut must be removed. Consequently, the second variant is suitable for powerful wall saws.

In the second development, the saw arm is rotated in the positive rotational direction from the negative first main cut angle into the positive second main cut angle and after the rotational movement into the positive second main cut angle the second upper exit point of the saw blade used coincides with the second end point if the pivot axis has a distance to the second end point, of $\sqrt{[h_2(D_2-h_2)]}+\delta \sin(+\alpha_2)$, where $h_2=h(+\alpha_2, D_2)=D_2/2-\Delta-\delta \cos(+\alpha_2)$ designates the penetration depth of the saw blade used into the workpiece with the positive second main cut angle with the second diameter, the second edge of the saw blade used coincides with the second end point if the pivot axis has a distance to the second end point of $D_2/2+\delta \sin(+\alpha_2)$, and the second edge of the blade guard used coincides with the second end point if the pivot axis has a distance to the second end point of $B_{2b}+\delta \sin(+\alpha_2)$.

The second development of the control method dispenses completely with a removal of the residual, material in the first main cut. The distance is set such that the second limit of the wall saw after the pivoting movement of the saw arm into the positive second main cut angle coincides with the second end point. This variant without removal of the residual material has the lowest nonproductive times; however, a stronger drive motor for the saw blade is necessary that can process the greater depth of cut at the end point.

Particularly preferred is the saw head with the saw arm inclined under the positive second main cut angle moved in the negative feed direction. The saw head is then moved in the processing controlled by the control unit such that a first limit of the wall saw facing the first end point after the pivoting movement of the saw arm from the positive second main cut angle into a new pivot angle coincides with the first end point, wherein the first limit of the wall saw is formed by a first upper exit point facing the first end point of the saw blade used on the upper side of the workpiece if the first end point is a free end point without barrier, by a first edge facing the first end point of the saw blade used if the first end point is a barrier and the processing occurs without blade guard, and by the first blade guard edge facing the first end point of the blade guard used if the first end point is a barrier and the processing is done with a blade guard.

The inventive method is characterized in that the first limit of the wall saw facing the first end point is also used for the control. After the pivoting movement of the saw arm into the new pivot angle the first limit of the wall saw coincides with the first end point, the new pivot angle in a first development corresponds to the negative second main cut angle of the second main cut and in a second development corresponds to the negative third main cut angle of the subsequent third main cut.

In the first development, the saw arm is pivoted in the negative rotational direction from the positive second main cut angle into the negative second main cut angle and after the pivoting movement into the negative second main cut angle the first upper exit point of the saw blade used coincides with the first end point if the pivot axis has a distance to the first end point of $\sqrt{[h_2(D_2-h_2)]}+\delta \sin(+\alpha_2)$, where $h_2=h(-\alpha_2, D_2)=D_2/2-\Delta-\delta \cos(-\alpha_2)$ designates the penetration depth of the saw blade used into the workpiece with the negative second main cut angle with the second diameter, the first edge of the saw blade used coincides with the first end point if the pivot axis has a distance to the first end point of $D_2/2-\delta \sin(-\alpha_2)$, and the first edge of the blade guard, used coincides with the first end point if the pivot axis has a distance to the first end point of $B_{2a}-\delta \sin(-\alpha_2)$.

In a first embodiment, the second main cut is the last main cut of the main cutting sequence. The saw arm is pivoted in the negative rotational direction from the positive second main cut angle into the negative second main cut angle and after the pivoting movement into the negative second main cut angle the first upper exit point of the saw blade used coincides with the first end point if the pivot axis has a distance to the first end point of $\sqrt{[h_2(D_2-h_2)]}-\delta \sin(-\alpha_2)$, where $h_2=h(+\alpha_2, D_2)=D_2/2-\Delta-\delta \cos(-\alpha_2)$ designates the penetration depth of the saw blade used into the workpiece with the negative second main cut angle with the second diameter, the first edge of the saw blade used coincides with the first end point if the pivot axis has a distance to the first end point of $D_2/2-\delta \sin(-\alpha_2)$, and the first edge of the blade guard used coincides with the first end point if the pivot axis has a distance to the first end point of $B_{2a}-\delta \sin(-\alpha_2)$.

Preferably, the saw head in the positive feed direction with saw arm inclined at the negative second main cut angle is moved by a path length of at least $2\delta|\sin(-\alpha_2)|$. This path length assures that the residual material of the second main cut is fully carried away.

Alternatively, the main cutting sequence comprises a third main cut performed after the second main cut with a third main cutting angle of the saw arm, a third diameter of the saw blade used and a third width of the blade guard used with a first and a second distance to the blade guard edges, wherein the saw arm in the third main cut is in a pulling arrangement and the saw head is moved in the positive feed direction.

In a first variant, the saw head is moved in the negative feed direction such that the first limit of the wall saw after the pivoting movement of the saw arm into the negative second main cut angle coincides with the first end point, wherein the first limit is formed by the first upper exit point facing the first end point of the saw blade used on the upper side of the workpiece if the first end point is a free end point without barrier, by a first edge facing the first end point of the saw blade used if the first end point is a barrier and the processing occurs without blade guard, and by a first edge facing the first end point of the blade guard used if the first end point is a barrier and the processing occurs with a blade guard.

To carry away the residual material, the saw head in the first feed direction with the saw arm inclined at the negative second main cutting angle is moved by a path length of at least $2\delta|\sin(-\alpha_2)|$ and the saw head is subsequently positioned such that the first limit of the wall saw after the pivoting movement of the saw arm in the negative third main cutting angle coincides with the first end point, wherein the first upper exit, point of the saw blade used coincides with the first end point if the pivot axis has a distance to the first end point ($E_1$) of $\sqrt{[h_3(D_3-h_3)]}-\delta \sin(-\alpha_3)$, where $h_3=h(-\alpha_3, D_3)=D_3/2-\Delta-\delta \cos(-\alpha_3)$ designates the penetration depth of the saw blade used into the workpiece with the negative third main cutting angle with the third diameter, the first edge of the saw blade used coincides with the first end point ($E_1$) if the pivot, axis has a distance to the first end point of $D_3/2-\delta \sin(-\alpha_3)$, and the first edge of the blade guard used coincides with the first end point if the pivot axis has a distance to the first end point of $B_{3a}-\delta \sin(-\alpha_3)$.

In a second variant the saw head is moved in the positive feed direction such that the first limit of the wall saw after the pivoting movement of the saw arm into the negative third main cutting angle coincides with the first end point, wherein the first upper exit point of the saw blade used coincides with the first end point if the pivot axis has a distance to the first end point of $\sqrt{[h_3(D_3-h_3)]}-\delta \sin(-\alpha_3)$, where $h_3=h(1\alpha_3, D_3)=D_3/2-\Delta-\delta \cos(-\alpha_3)$ designates the penetration depth of the saw blade used into the workpiece with the negative third main cutting angle with the third diameter, the first edge of the saw blade used coincides with the first end point if the pivot axis has a distance to the first end point of $D_3/2-\delta \sin(-\alpha_3)$, and the first edge of the blade guard used coincides with the first end point if the pivot axis has a distance to the first end point of $B_{3a}-\delta \sin(-\alpha_3)$.

In a third variant, the saw arm is pivoted in the negative rotational direction from the positive second main cutting angle into the negative third main cutting angle and after the pivoting movement into the negative third main cutting angle the first upper exit point of the saw blade used coincides with the first end point if the pivot axis has a distance to the first end point of $\sqrt{[h_3(D_3-h_3)]}+\delta \sin(-\alpha_3)$, where $h_3=h(-\alpha_3, D_3)=D_3/2-\Delta-\delta \cos(-\alpha_3)$ designates the penetration depth of the saw blade used into the workpiece with the negative third main cutting angle ($-\alpha_3$) with the third diameter, the first edge of the saw blade used coincides with the first end point if the pivot axis has a distance to the first end point ($E_1$) of $D_3/2-\delta \sin(-\alpha_3)$, and the first edge of the blade guard used coincides with the first end point if the pivot axis has a distance to the first end point of $B_{3a}-\delta \sin(-\alpha_3)$.

The third variant dispenses completely with a removal of the residual material in the second main cut. The distance is set such that the first limit of the wall saw after the pivoting movement of the saw arm coincides with the first end point. The variant without removal, of the residual material has the lowest nonproductive times; however, a stronger drive motor is necessary that can process the greater depth of cut at the end point.

The first and second main cuts are done with a saw blade and a blade guard, or alternatively the first main cut is done with a first saw blade and a first blade guard, wherein the first saw blade has a first saw blade diameter and the first blade guard has a first blade guard width and the second main cut is done with a second saw blade and a second blade guard wherein the second saw blade has a second saw blade diameter and the second blade guard has a second blade guard width.

In a preferred variant, the first main cut of the main cutting sequence is a precut and the saw head after the start of the processing controlled by the control unit is positioned in a start position, wherein in the start position the first limit of the wall saw facing the first end point after the pivoting movement into the negative first main cutting angle coincides with the first end point.

The first upper exit point of the saw blade used coincides with the first end point if the pivot axis has a distance to the first end point of $\sqrt{[h_1(D_1-h_1)]}-\delta \sin(-\alpha_1)$, where $h_1=h(\alpha_1, D_1)=D_1/2-\Delta-\delta \cos(-\alpha_1)$ designates the penetration depth of the saw head used into the workpiece with the negative first main cutting angle with the first diameter, the first edge of the saw blade used coincides with the first end point if the pivot axis has a distance to the first end point of $D_1/2-\delta \sin(-\alpha_1)$, and the first edge of the blade guard used coincides with the first end point if the pivot axis has a distance to the first end point of $B_{1a}-\delta \sin(-\alpha_1)$.

The inventive method applies to all main cuts in which the main cutting angle is smaller than or equal to a critical pivot angle. The critical pivot angle corresponds to ±90° if the end point is a barrier, and the critical pivot angle corresponds to 180°—across[Δ/(δ+D/2] if the end point is a free end point without barrier.

Embodiments of the invention are described below based on the drawings. These do not necessarily represent the embodiments to scale; instead, where helpful for the explanation the drawings are produced in schematic and/or slightly distorted form. Regarding additions to the teachings directly evident from the drawings, reference is made to the relevant prior art. It must be kept in mind that various modifications and changes to the form and detail of an embodiment can be made without deviating from the general idea of the invention. The invention's features disclosed in the description, drawings and claims can be essential both individually and in any combination for the development of the invention. In addition, all combinations of at least two of the features described in the description, drawings and/or claims fall within the framework of the invention. The general idea of the invention is not restricted to the exact shape or detail of the embodiments shown and described below or restricted to a subject matter that would be restricted compared to the subject matter claimed in the claims. Where dimension areas are given, values lying inside the given boundaries are also disclosed as limit values and can be used and claimed randomly. For the sake of simplicity, the same reference signs are used below for identical or similar parts or parts with identical or similar function.

DETAILED DESCRIPTION OF THE DRAWINGS

Figure 1:
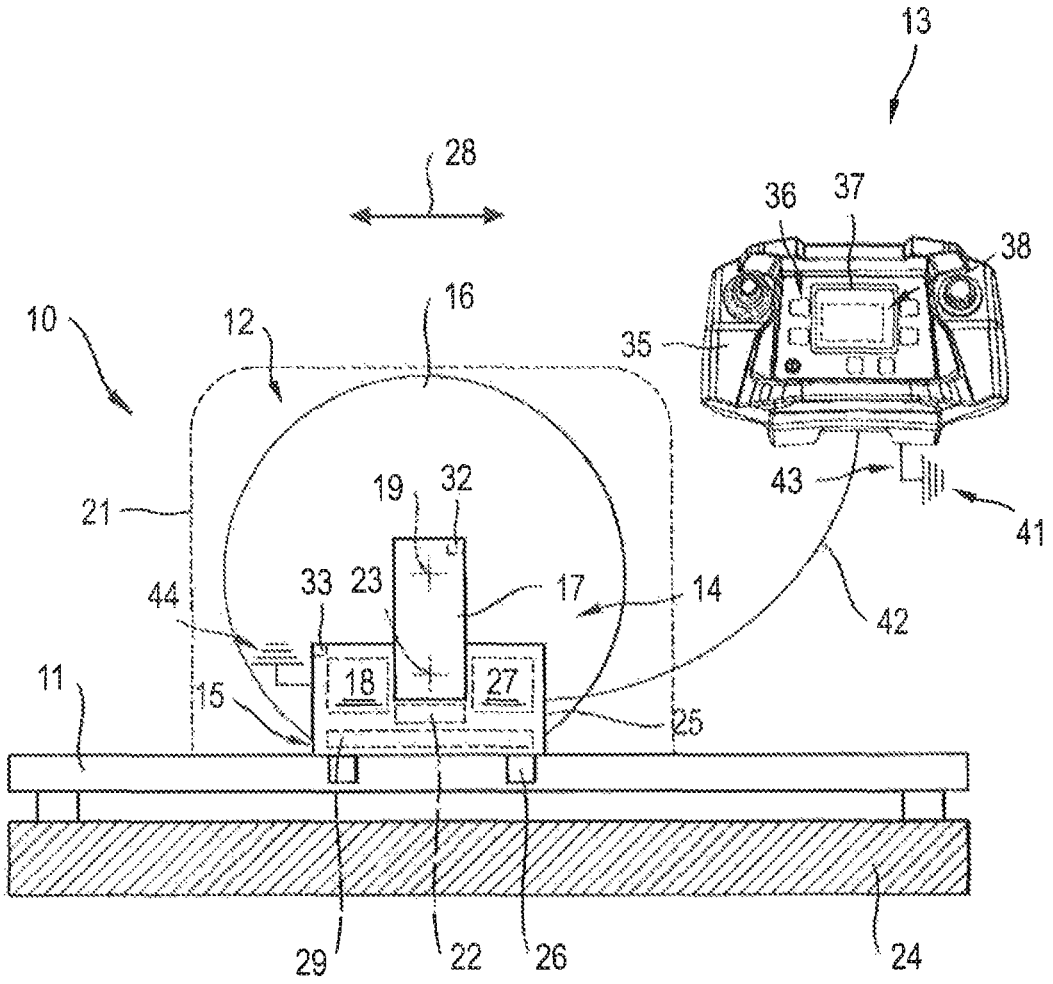
FIG. 1 illustrates a wall saw with a guide rail and a wall saw.

FIG. 1 shows a wall saw system 10 with a guide rail 11, a tool device 12 arranged displaceable on the guide rail 11 and a remote control 13. The power tool is configured as a wall saw 12 and comprises a processing unit 14 and a motor-driven feed unit 15. The processing unit is configured as a saw head 14 and includes a machining tool 16 designed as a saw blade, which is attached to a saw arm 17 and is driven by a drive motor 18 about an axis of rotation 19.

To protect the operator, the saw blade 16 is surrounded by a blade guard 21, which is secured by means of a blade guard holder on the saw arm 17. The saw arm 17 is formed from a pivoting motor 22 to pivot about a pivot axis 23. The pivot angle α of the saw arm 17 determines with a blade diameter D of the saw blade 16, how deep the blade 16 dips into a workpiece 24 to be processed. The drive motor 18 and the pivoting motor 22 are arranged in a device housing 25. The motor-driven feed unit 15 comprises a guide carriage 26 and a feed motor 27 that in the embodiment is also arranged in the device housing 25. The saw head 14 is fixed on the guide carriage 26 and designed to be displaceable through the feed motor 27 along the guide rail 11 in a feed direction 28. In the device housing 25 in addition to the motors 19, 22, 27 a control unit 29 is arranged for controlling the saw head 14 and the motor-driven feed unit 15.

To monitor the wall saw 10 and the processing procedure, a sensor device is provided with several sensor elements. A first sensor element 32 is designed as a pivot angle sensor and a second sensor element 33 as a displacement sensor. The pivot angle sensor 32 measures the current pivot angle of the saw arm 17 and the displacement sensor 33 measures the current position of the saw head 14 on the guide rail 11.

The measured values are transmitted by the pivot angle sensor 32 and displacement sensor 33 to the control unit 29 and used for controlling the wall saw 12.

The remote control 13 comprises a device housing 35, an input device 38, a display device 37, and a control unit 38 that is arranged in the interior of the device housing 35. The control unit 38 converts the inputs of the input device 36 into control commands and data that are transmitted via a first communication link to the wall saw 12. The first communication link is configured as a wireless and cordless communication link 41 or a communications cable 42. The wireless and cordless communication link is formed in the embodiment as a radio link 41 created between a first radio unit 43 on the remote control 13 and a second radio unit 44 on the power tool 12. Alternatively, the wireless and cordless communication link 41 can be in the form of an infrared, Bluetooth, WLAN or Wi-Fi connection.

Figure 2A:
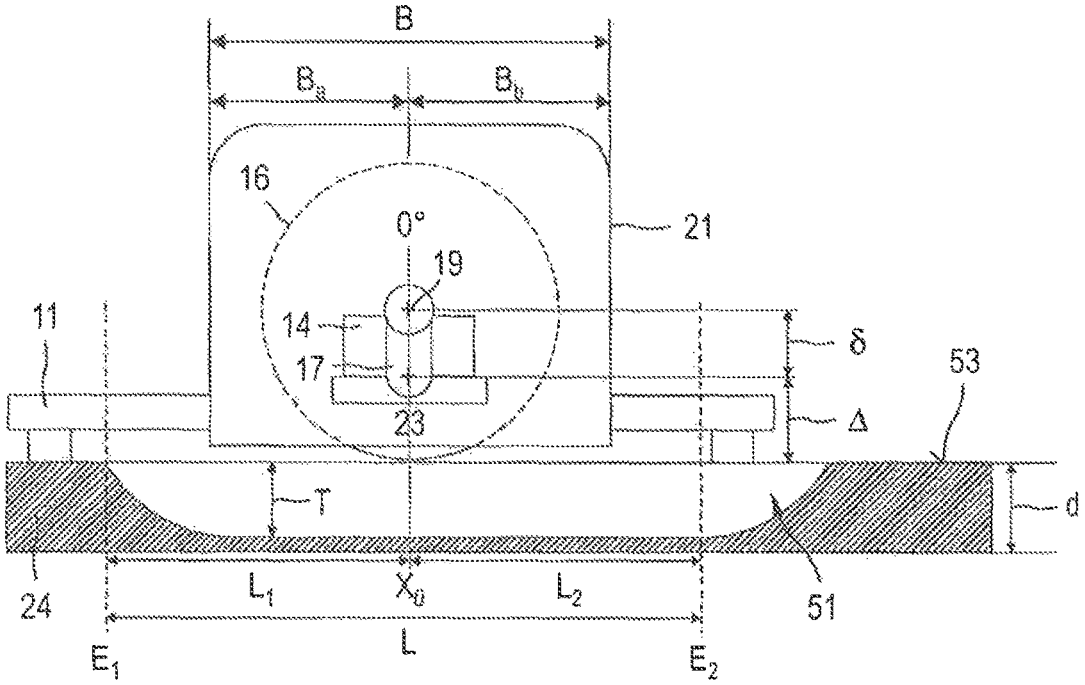
FIGS. 2A, B illustrate processing of a separation cut between a first and second free end point without barrier.

FIGS. 2A, B show the guide rail 11 and the wall saw 12 of the wall saw system 10 of FIG. 1 at the creation of a separation cut 51 in the workpiece 24 of workpiece thickness d. The separation cut 51 has a final depth T and extends in the feed direction 28 between a first end point $E_1$ and a second end point $E_2$. A direction parallel, to the feed direction 28 is defined as the X direction, wherein the positive X direction is from the first end point $E_1$ to the second end point $E_2$, and a direction perpendicular to the X direction into the workpiece 24 is defined as the Y direction.

The end point of a separation cut can be defined as free end point without barrier or as barrier. Both end points can be defined as free end points without barrier, both end points as barrier, or one end point as free end point and the other end point as barrier. An overcut can be allowed at a free end point without barrier. Through the overcut, at the end point the depth of cut reaches the final depth T of the separation cut. In the embodiment of FIGS. 2A, B the end points $E_1$, $E_2$ form free end points without barrier, wherein on the free first end point $E_1$ an overcut is not permissible and on the second end point $E_2$ there is an overcut.

FIG. 2A shows the saw head 14 in a mounting position $X_0$ and the saw arm 17 in a basic position of 0°. The saw head 14 is positioned by the operator by means of the guide carriage 26 in the mounting position $X_0$ on the guide rail 11. The mounting position $X_0$ of the saw head 14 lies between the first and second end points $E_1$, $E_2$ and is determined by the position of the pivot axis 23 in feed direction 28. The position of the pivot axis 23 is particularly suited as reference position $X_{Ref}$ for the position monitoring of the saw head 14 and control of the wall saw 12, since the X position of the pivot axis 23 also remains unchanged during the pivoting movement of saw arm 17. Alternatively, another X position on the saw head 14 can be established as reference position, wherein in this case the distance in the X direction to the pivot axis 23 must additionally be known.

The X positions of the first and second end points $E_1$, $E_2$ are determined in the embodiment by the entry of partial lengths. The distance between the mounting position $X_0$ and the first end point $E_1$ determines a first partial length $L_1$ and the distance between the mounting position $X_0$ and the second end point $E_2$ a second partial length $L_2$. Alternatively, the X positions of the end points $E_1$, $E_2$ can be established by entering a partial length ($L_1$ or $L_2$) and a total length L as the distance between the end points $E_1$, $E_2$.

The separation cut 51 is produced in multiple partial cuts until the desired final depth T is reached. The partial cuts between the first and the second end points $E_1$, $E_2$ are defined as the main cut and the cutting sequence of the main cut as the main cutting sequence. At the end points of the separation cut an additional corner processing can be performed, which with a barrier is called barrier processing and with a free end point with overcut is called overcut processing.

The main cutting sequence can be determined by the operator, or the control unit of the wall saw system determines the main cutting sequence depending on several boundary conditions. Usually the first main cut, also called precut, is made with a reduced depth of cut and a reduced power of the drive motor to prevent a polishing of the saw blade. The remaining main cuts are normally done with the same depth of cut, but can also have different cut depths. The boundary conditions usually established by an operator include the cut depth of the precut, the power of the precut, and the maximum depth of cut of the remaining main cuts. The control unit can determine the main cutting sequence from these boundary conditions.

The main cuts of a separation cut are done with one saw blade diameter or with two or more saw blade diameters. If multiple saw blades are used, the processing usually starts with the smallest saw blade diameter. To be able to mount the saw blade 18 on the saw arm 17, in the basic position, of saw arm 17 the saw blade 18 must be arranged above the workpiece 24. Whether this boundary condition is fulfilled depends on two device-specific sizes of the wall saw system 10: a perpendicular distance Δ between the pivot axis 23 of saw arm 17 and an upper side 53 of the workpiece 24; and the saw arm length δ of saw arm 17, defined as the distance between the axis of rotation 19 of saw blade 16 and the pivot axis 23 of saw arm 17. If the total of these two device-specific amounts is greater than half the saw blade diameter D/2, the saw blade 18 in the basic position is arranged above the workpiece 24. The saw arm length δ is a fixed device-specific amount of wall saw 12, whereas the perpendicular distance Δ between the pivot axis 23 and the surface 53 besides the geometry of wall saw 12 also depends on the geometry of the guide rail 11 used.

The saw blade 18 is fastened on a flange on saw arm 17 and in the saw operation is driven by drive motor 18 around the axis of rotation 19. In the basic position of saw arm 17, shown in FIG. 2A, the pivot angle is 0° and the axis of rotation 19 of the saw blade 16 lies in depth direction 52 above pivot axis 23. The saw blade 18 is moved by a pivoting movement of saw arm 17 around the pivot axis 23 from the basic position at 0° into the workpiece 24. During the pivoting movement of saw arm 17, saw blade 16 is driven by drive motor 18 around the axis of rotation 19.

To protect the operator, during operation the saw blade 16 should be surrounded by blade guard 21. Wall saw 12 is operated either with blade guard 21 or without blade guard 21. For processing of the separation cut in the area of end points $E_1$, $E_2$, a dismounting of blade guard 21 can be provided. If different saw blade diameters are used for processing the separation cut, different blade guards with corresponding blade guard width are also used.

Figure 2B:
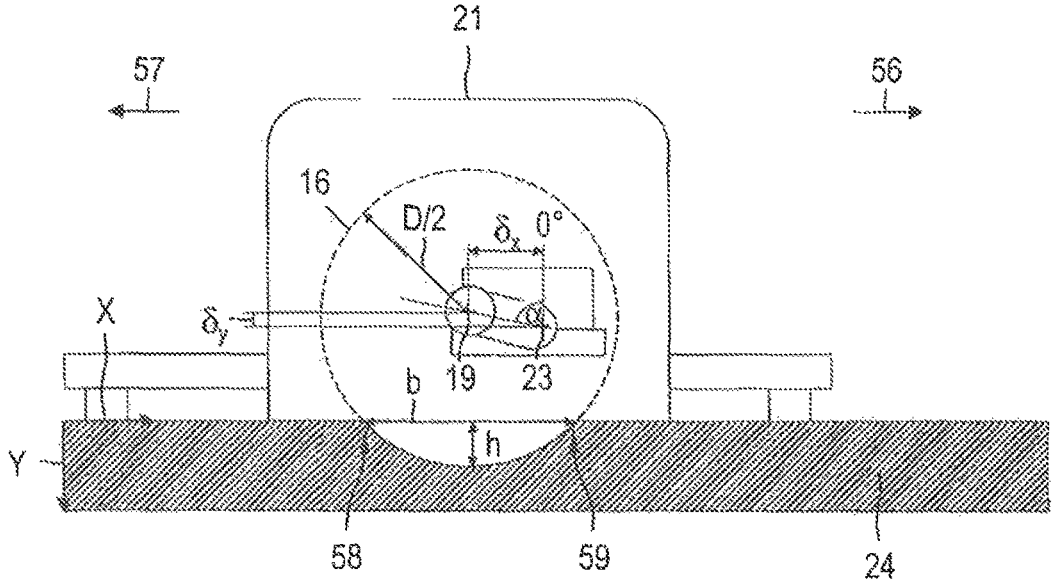

FIG. 2B shows saw arm 17, which in the negative axial direction 54 is inclined at negative pivot angle −α. In the negative rotational direction 54 the saw arm 17 is adjustable between pivot angles from 0° to −180°, and in a positive rotational direction 55 counter to the negative rotational direction 54 is adjustable between pivot angles from 0° to +180°. The arrangement of saw arm 17 shown in FIB. 2B is identified as pulling if saw head 14 is moved in a positive feed direction 56. If saw head. 14 is moved in a negative feed direction 57 counter to the positive feed direction 56, the arrangement of saw arm 17 is called pushing.

The maximum penetration depth of saw blade 16 into workpiece 24 is reached at a pivot angle of ±180°. The position of the axis of rotation 19 in the X direction and Y direction is shifted by the pivoting movement of saw arm 17 around pivot axis 23. The displacement of pivot axis 19 depends on the saw arm length δ and pivot axis a of saw arm 17. The displacement $\delta_x$ in the X direction is $\delta \sin(\pm\alpha)$ and the displacement $\delta y$ in the Y direction is $\delta \cos(\pm\alpha)$.

The saw blade 16 produces in workpiece 24 a cutting edge in the shape of a circular segment with a height h and width b. The height h of the circular segment corresponds to the penetration depth of saw blade 16 into workpiece 24. The relationship $D/2=h+\Delta+\delta\cdot\cos(\alpha)$ applies for the penetration depth h, where D designates the saw blade diameter, h the penetration depth of saw blade 16, Δ the perpendicular distance between pivot axis 23 and upper side 53 of workpiece 24, δ the saw arm length and a the first pivot angle, and for the width b relationship $b^2=D/2*8h-4h^2-4Dh-4h^2=4h\cdot(D-h)$ applies, where h designates the penetration depth of saw blade 16 into workpiece 24 and D the saw blade diameter.

The control of wall saw 12 during the separation cut depends on whether the end points are defined as barriers, and if there is a barrier whether the processing is done with blade guard 21 or without blade guard 21. With a free end point without barrier, the control of wall saw 12 in the inventive method occurs through upper exit points of saw blade 16 at upper side 53 of workpiece 24. The upper exit points of saw blade 16 can be calculated from the reference position $X_{Ref}$ of pivot axis 23 in the X direction, displacement $\delta_x$ of axis of rotation 19 in the X direction, and width b. An upper exit point facing the first end point $E_1$ is designated as first upper exit point 58, and an upper exit point facing the second end point $E_2$ as second upper exit point 59. For the first upper exit point 58 applies $X(\mathbf{58})=X_{Ref}+\delta_x-b/2$, and for the second upper exit point 59 applies $X(\mathbf{59})=x_{Ref}+\delta_x+b/2$ with $b=\infty[h\cdot(D-h)]$ and $h=h(\alpha, D)$.

If the end points $E_1$, $E_2$ are defined as barriers, an overrun of the end points $E_1$, $E_2$ with wall saw 12 is not possible. In this case the control of wall saw 12 in the inventive method occurs through the reference position $X_{Ref}$ of pivot axis 23 and the limit of wall saw 12. A distinction is made between a processing without blade guard 21 and a processing with blade guard 21.

Figure 3A:
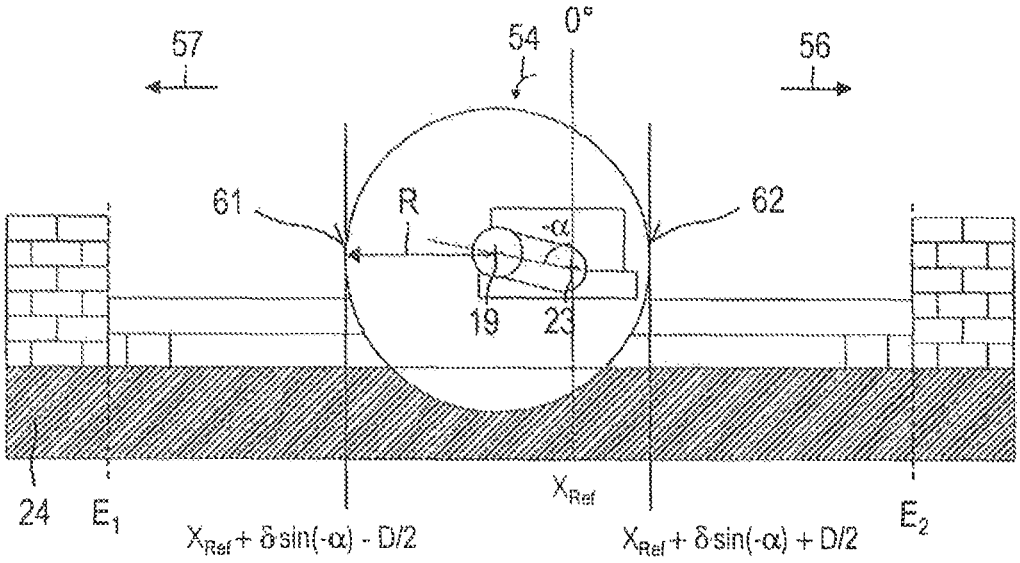
FIGS. 3A, B illustrate processing of a separation cut between a first and second barrier with a saw blade that is not surrounded by a blade guard.

FIGS. 3A, B show the wall saw system 10 when producing a separation cut between the first end point $E_1$ and the second end point $E_2$, which are defined as barriers, wherein the processing occurs without blade guard 21. In the processing without blade guard 21, a first blade guard edge 61 facing the first end point $E_1$ and a second blade guard edge 62 facing the second end point $E_2$ form the limit of the wall saw 12.

Figure 3B:
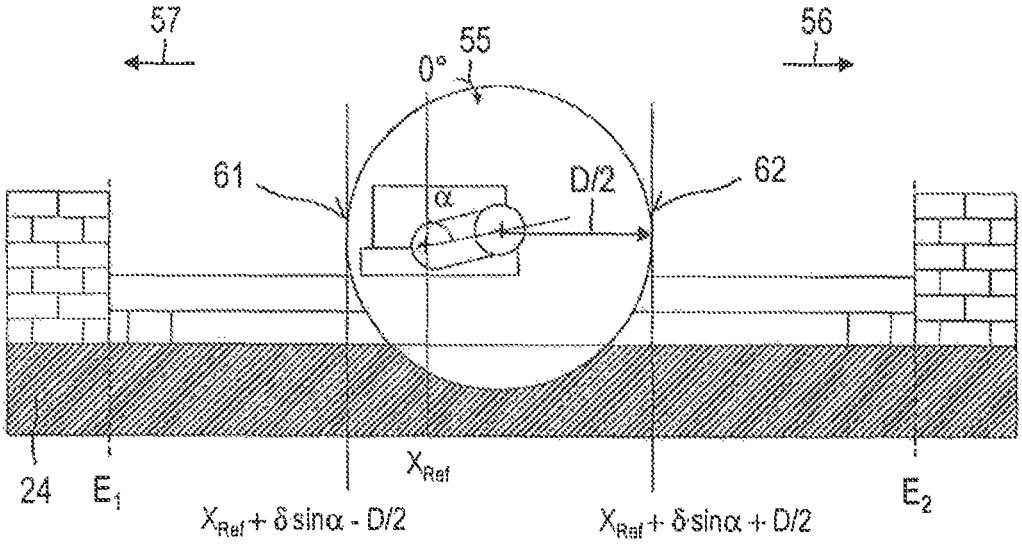

The X positions of the first and second saw blade edges 61, 62 in the X direction can be calculated from the reference position $X_{Ref}$ of pivot axis 23, displacement $\delta_x$ of axis of rotation 19 and saw blade diameter D. FIG. 3A shows the wall saw 12 with the saw arm 17 inclined in the negative rotational direction 54 at a negative pivot angle −α(0° to −180°). For the first saw blade edge 61 applies $X(\mathbf{61})=X_{Ref}+\delta \sin(-\alpha)-D/2$ and for the second saw blade edge 62 applies $X(\mathbf{62})=X_{Ref}+\delta \sin(-\alpha)+D/2$. FIG. 3B shows wall saw 12 with saw arm 17 inclined in a positive rotational direction 55 at a positive pivot angle α(0° to +180°). For the first saw blade edge 61 applies $X(\mathbf{61})=X_{Ref}+\delta \sin(\alpha)-D/2$ and for the second saw blade edge 62 applies $X(\mathbf{62})=X_{Ref}+\delta \sin(\alpha)+D/2$.

Figure 4A:
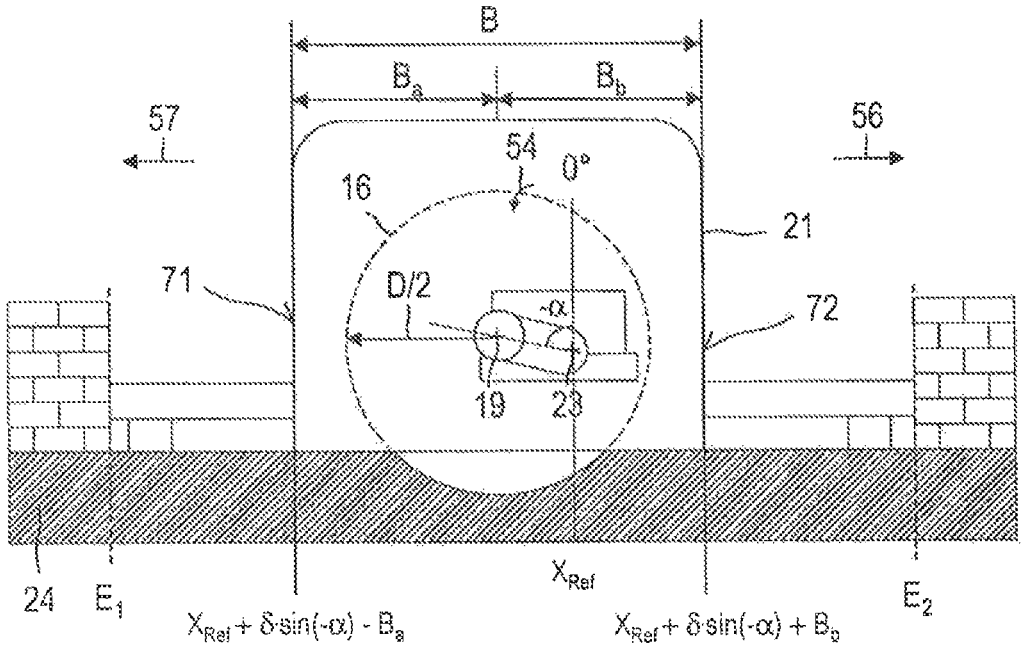
FIGS. 4A, B illustrate processing of a separation cut between a first and second barrier with a saw blade that is surrounded by a blade guard.

FIGS. 4A, B show the wall saw system 10 when creating a separation cut between the first end point $E_1$ and the second end point $E_2$, defined as barriers, wherein the processing is done with blade guard 21. In the processing without blade guard 21, a first blade guard edge 71 facing the first end point $E_1$, and a second blade guard edge 72 facing the second end point $E_2$, form the limit of wall saw 12.

The X positions of the first and second blade guard edges 71, 72 in the X direction can be calculated from the reference position $X_{Ref}$ of pivot axis 23, displacement $\delta_x$ of axis of rotation 19 and blade guard width B. FIG. 4A shows the wall saw 12 with saw arm 17 inclined at a negative pivot angle −α(0° to −180°), and a mounted blade guard 21 of blade guard width B. In an asymmetrical blade guard, before the start of the control processing the distances of the axis of rotation 19 to the blade guards 71, 72 are determined, wherein the distance to the first blade guard edge 71 is identified as first distance $B_a$ and the distance to the second blade guard edge 72 as second distance $B_b$.

Figure 4B:
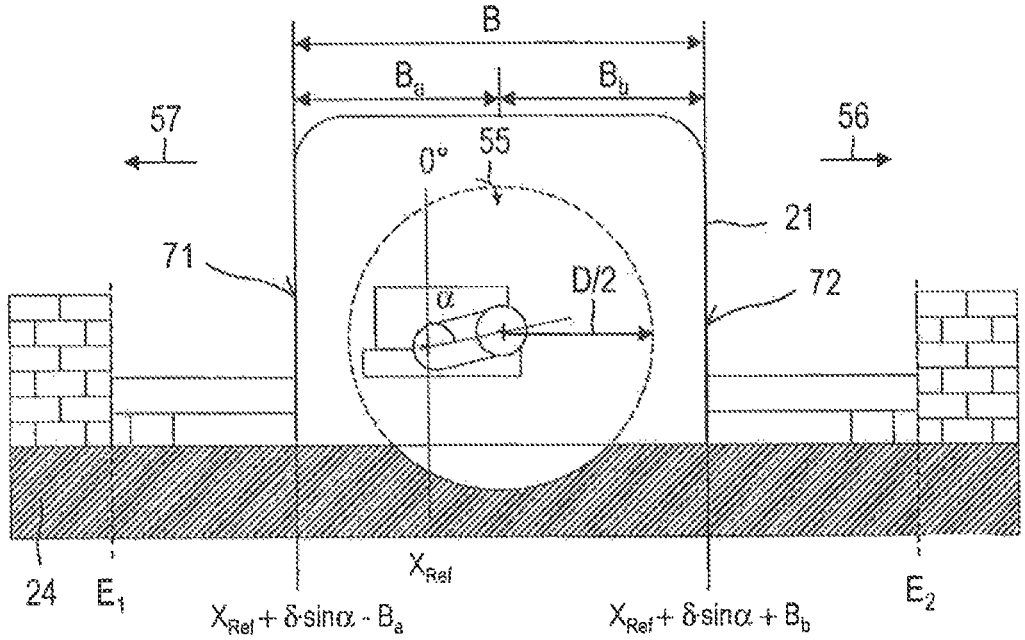

For the first blade guard edge 71 applies $X(\mathbf{71})=X_{Ref}+\delta\cdot\sin(\alpha)\cdot B_a$ and for the second blade guard edge 72 applies $X(\mathbf{72})=X_{Ref}+\delta\cdot\sin(\alpha)+B_b$. FIG. 4B shows the wall saw 12 with the saw arm 17 inclined at positive swivel angle α(0° to +180°), and the mounted blade guard 21 of the blade guard width B. For the first blade guard edge 71 applies $X(\mathbf{71})=X_{Ref}+\delta\cdot\sin(\alpha)-B_a$ and for the second blade guard edge 72 applies $X(\mathbf{72})=X_{Ref}+\delta\cdot\sin(\alpha)+B_b$.

FIGS. 2A, B show a separation cut between two end points $E_1$, $E_2$, which are defined as free end points without barrier, and FIGS. 3A, B and 4A, B show a separation cut between two end points $E_1$, $E_2$, which are defined as barriers. In practice, separation cuts are also possible in which one end point is defined as a barrier and the other end is a free end without barrier, wherein the control of the wall saw with the free end point occurs through the upper exit point of the saw blade and with the barrier through the blade edge (processing without blade guard 21) or the blade guard edge (processing with blade guard 21).

The first upper exit point 58, the first blade edge 61 and the first blade edge guard 71 are summarized under the term "first limit" of wall saw 12 and the second upper exit point 59, the second blade edge 62 and the second blade guard edge 72 are summarized under the term "second limit."

Figure 5A:
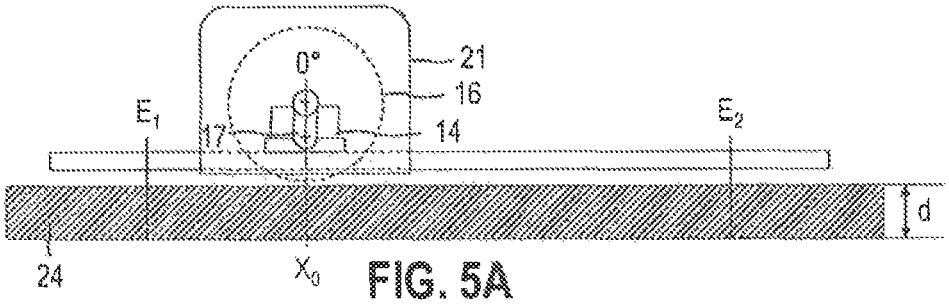
FIGS. 5A-N illustrate the wall saw of FIG. 1 in creating a separation cut between a first free end point without barrier and a second free end without barrier with the help of the inventive method.
Figure 5B:
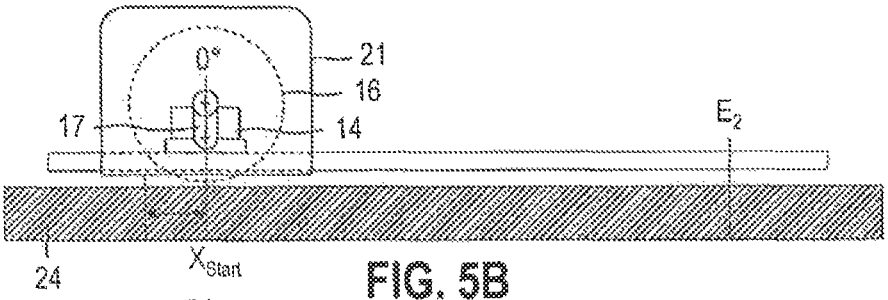
Figure 5C:
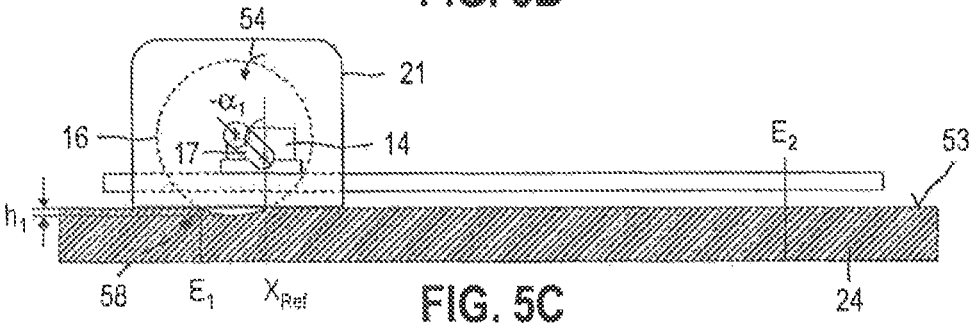
Figure 5D:
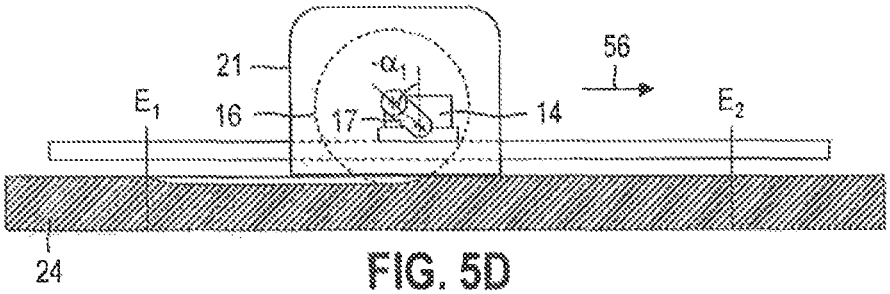
Figure 5E:
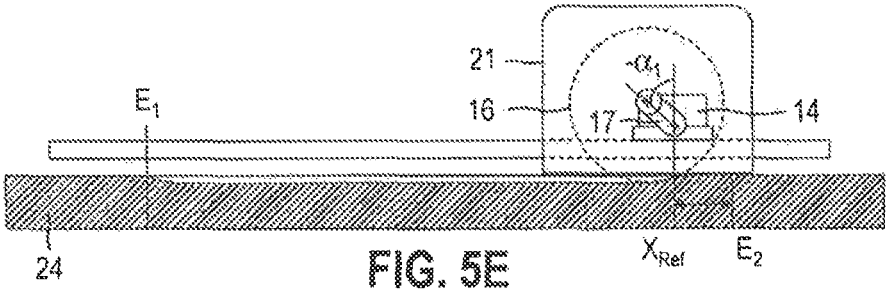
Figure 5F:
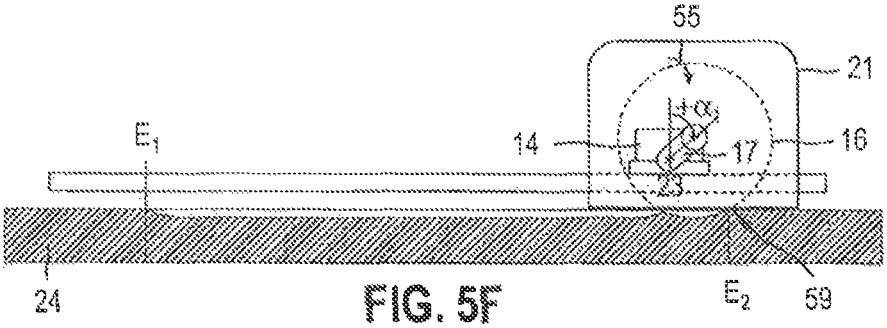
Figure 5G:
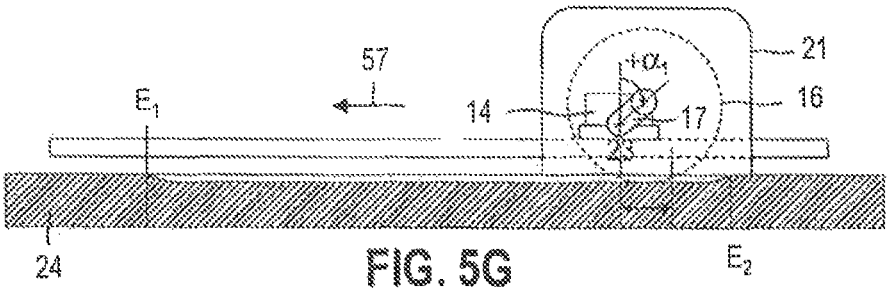
Figure 5H:
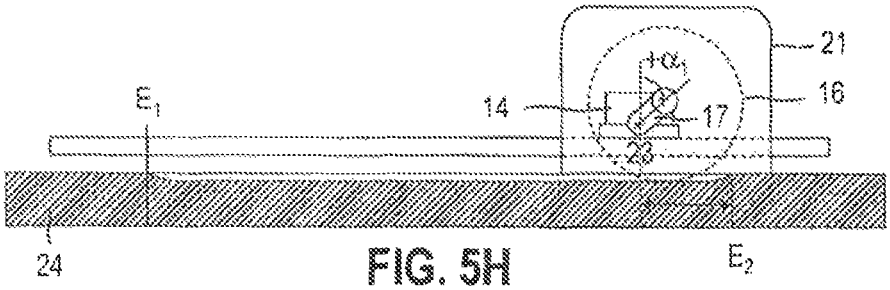
Figure 5I:
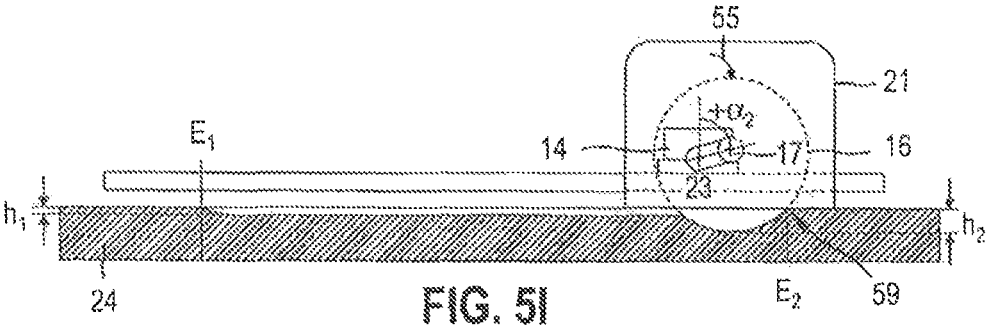
Figure 5J:
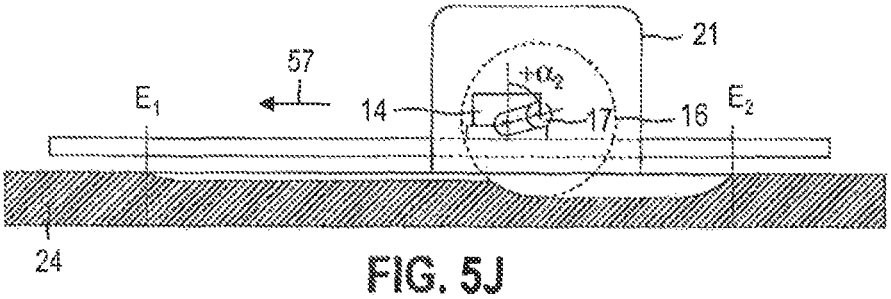
Figure 5K:
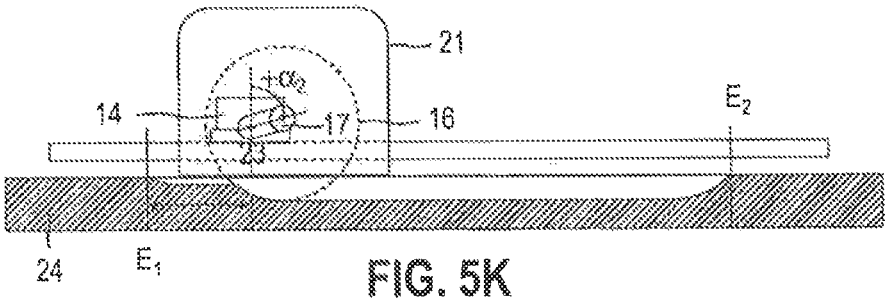
Figure 5L:
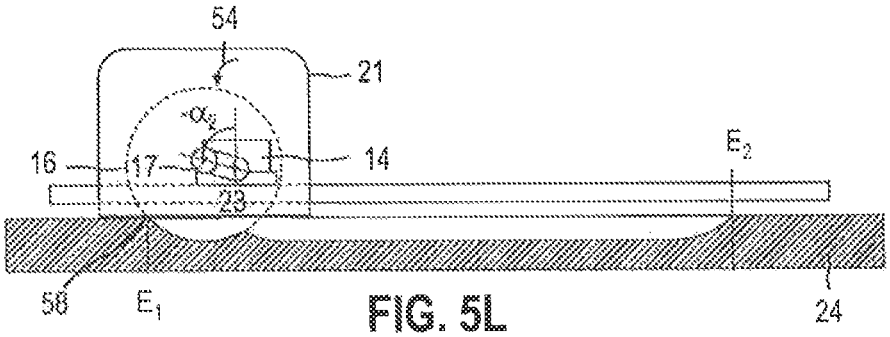
Figure 5M:
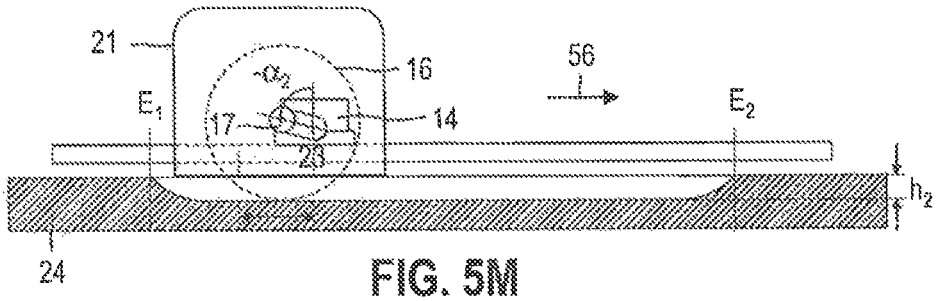
Figure 5N:
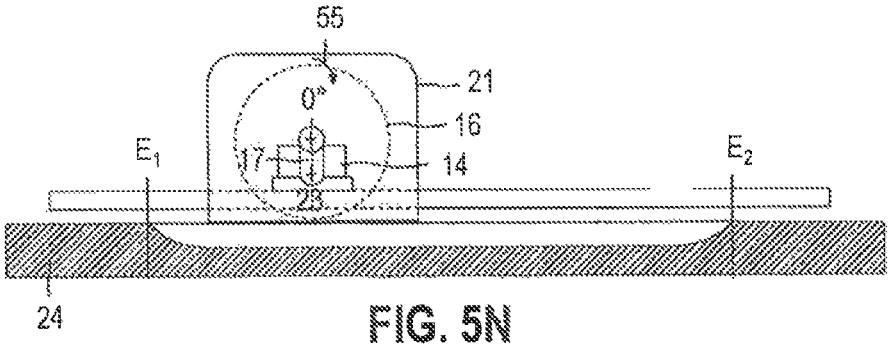

FIGS. 5A-N show the wall saw system 10 of FIG. 1 with the guide rail. 11 and wall saw 12 when creating a separation cut of final depth T in the workpiece 24 between the first end point $E_1$, which is defined as a free end point without barrier, and the second end point $E_2$, which is also defined as a free end point without barrier. The control of the wall saw 12 is done on the first end point $E_1$ through the first upper exit point 58 of the saw blade used and the second end point $E_2$ through the second upper exit point 59 of the saw blade used.

The processing of the separation cut is effected with the aid of the inventive method for controlling a wall saw system. The separation cut comprises a main cutting sequence of at least two main cuts, done between the first end point $E_1$ and the second end point $E_2$, as well as a first corner processing at the first end point $E_1$ and a second corner processing at the second end point $E_2$. If an overcut is permitted at an end point, an overcut sequence is defined for the free end point, otherwise a corner cutting sequence is defined.

The main cutting sequence comprises a first main cut having a first main cutting angle α of the saw arm 17, a first diameter $D_1$ of the saw blade used, a first penetration depth $h_1$ of the saw blade used in the workpiece 24 and a first width $B_1$ of the blade guard used, as well as a following second main cut with a second main cutting angle $\alpha_2$ of the saw arm 17, a second diameter $D_2$ of the saw blade used, a second penetration depth $h_2$ of the saw blade used in the workpiece 24 and a second width $B_2$ of the blade guard used.

The first and second main cuts are performed in the embodiment with the same saw blade 18 and the same blade guard 21. Therefore, the first diameter $D_1$ of the first main cut and the second diameter $D_2$ of the second main cut match the saw blade diameter D of the saw blade 18, and the first width $B_1$ of the first main cut and second width $B_2$ of the second main cut match the blade guard width B of saw blade 16. In the embodiment, the blade guard 21 is constructed symmetrically and the distance of the axis of rotation 19 to the blade guard edges 71, 72 corresponds to B/2. In an asymmetric blade guard the first distance $B_a$ to the first blade guard edge 71 and the second distance $B_b$ to the second blade guard edge 72 are used.

FIG. 5A shows the wall saw 12 in the mounting position $X_0$ of saw head 14 and the basic position 0° of saw arm 17. After the start of the inventive method, the saw head 14 is moved from the mounting position $X_0$ into a starting position $X_{Start}$ (FIG. 5B). In the embodiment, the processing of the first main cut starts at the first end point $E_1$. In the starting position $X_1$, the pivot axis 23 has a distance of $\sqrt{[h_1\cdot(D_1\cdot h_{1)}]}-\delta\cdot\sin(-\alpha_1)$ to the first end point $E_1$, where $h_1=h(-\alpha_1, D_{1)}-D_1/2\Delta-\delta\cdot\cos(-\alpha_1)$ designates the penetration depth of the saw blade 16 used into the workpiece 24 at negative first main cutting angle $-\alpha_1$.

For insertion of saw blade 16 into workpiece 24, saw blade 16 is driven by drive motor 18 around the axis of rotation 19 and saw arm 17 is pivoted from the basic position 0° in the negative rotational direction 54 about the pivot axis 23. The pivot angle of saw arm 17 is measured regularly during the pivoting movement of the pivot angle sensor 32. Once the negative first main, cutting angle $-\alpha_1$ is reached, the pivoting movement of saw arm 17 is interrupted (FIG. 5C). When positioning the saw head 14 in FIG. 5B the distance from the first end point $E_1$ was set such that the first upper exit point 58 facing the first end point $E_1$ of saw blade 16 after the pivoting of saw arm 17 in the negative first main cutting angle $-\alpha_1$ coincides the first end point $E_1$.

The saw head 14 is moved in the positive feed direction 56 to the second end point $E_2$ (FIG. 5D). The position of saw head 14 is measured regularly by displacement sensor 33 during the feed movement. The feed movement is stopped when pivot axis 23 has a distance of $\sqrt{[h_1\cdot(D_1-h_1)]}+\delta\cdot\sin(-\alpha_1)$ to the second end point $E_2$ (FIG. 5E). Then saw arm 17 is rotated in the positive rotational direction 55 about pivot axis 23 from the negative first main cutting angle $-\alpha_1$ in the positive first main cutting angle $+\alpha_1$ (FIG. 5F). In calculating the distance to the second end point $E_2$ the displacement of the rotation axis 19 through the shift from $-\alpha_1$ to $+\alpha_1$ was considered. The distance was set so that the second upper exit point 59 of saw blade 16 facing the second end point $E_2$ coincides after the pivotal movement of saw arm 17 in the positive first main cutting angle $+\alpha_1$ with the second end point $E_2$.

By the pivoting of saw arm 17 residual material remains in the region of pivot axis 23 that still has to be removed from the saw blade 16. The residual material can be removed in a separate step or the residual material is removed with the following main cut. In the embodiment shown in FIG. 5G the residual material is removed completely in the first main cut. For this purpose, saw head 14 after pivoting in the negative direction 57 is displaced by path length of $2\delta|\sin(-\alpha_1)|$ (FIG. 5G). After the removal the first main cut is finished and the second main cut starts with the positioning of saw head 14.

The saw head 14 is positioned in feed direction 28 so that the pivot axis 23 has a distance of $\sqrt{[h_2\cdot(D_2-h_2)]}+\delta\cdot\sin(+\alpha_2)$ to the second end point $E_2$ (FIG. 5H). In this position saw arm 17 is rotated from the positive first main cutting angle $+\alpha_1$ in the positive second main cutting angle $+\alpha_2$ (FIG. 5I). When positioning in FIG. 5H the distance is adjusted so that the second upper exit point 59 of saw blade 16 facing the second end point $E_2$ coincides after the pivotal movement of saw arm 17 in the positive second main cutting angle $+\alpha_2$ with the second end point $E_2$.

The saw head 14 is moved in the negative feed direction 57 to the first end point $E_1$ (FIG. 5J), wherein the position of saw head 14 during the feed movement of displacement sensor 33 is measured regularly. The feed movement is stopped when the pivot axis 23 has a distance of $\sqrt{[h_2\cdot(D_2-h_2)]}-\delta\cdot\sin(+\alpha_2)$ to the first end point $E_1$ (FIG. 5K). The saw arm 17 is rotated in the negative rotational direction 54 and disposed in the negative second main cutting angle $-\alpha_2$ (FIG. 5L). When setting the distance to the first end point $E_1$ in FIG. 5K the distance was set such that the first upper exit point 58 of saw blade 16 facing the first end point $E_1$ after the pivoting movement of saw arm 17 in the negative second main cutting angle $-\alpha_2$ coincides with the first end point $E_1$.

For removing the residual material, saw head 14 is displaced in the positive feed direction 56 by a path length of $2\delta\cdot|\sin(-\alpha_{2)}|$ (FIG. 5M). After the removal the second main cut, and thus also the separation cut between the first and second end points $E_1$, $E_2$ are terminated. At the end of the inventive method the saw arm 17 is moved to the basic position 0° (FIG. 5N).

In the FIGS. 5E to 5H are shown a complete removal of the residual material at the end of the first main cut and the positioning of saw head 14 for the second main cut. In a first alternative variant the removal of the residual material and the positioning of saw head 14 are combined. After pivoting of saw arm 17 in the positive first main cutting angle $+\alpha_1$ the saw head 14 is moved in the negative feed direction 57 until the pivot axis 23 has a distance of $\sqrt{[h_2\cdot(D_2-h_2)]}-\delta\cdot\sin(+\alpha_2)$ to the second end point $E_2$. The distance is adjusted so that the second upper exit point 59 of saw blade 16 coincides in the positive second, main cutting angle $+\alpha_2$ with the second end point $E_2$ after the pivotal movement of saw arm 17.

In an alternative second variant, the removal of the residual material is omitted. The saw head 14 is stopped, by the control unit 29 in a position in which the pivot axis 23 in feed direction 28 has a distance of $\sqrt{[h_2\cdot(D_2\cdot h)]}\cdot\delta\cdot\sin(+\alpha_2)$ to the second end point $E_2$. In this position saw arm 17 is pivoted from the negative first main cutting angle $-\alpha_1$ of in the positive second main cutting angle $+\alpha_2$. The distance is adjusted so that the second upper exit point 59 of saw blade 16 facing the second end point $E_2$ after the pivotal movement of saw arm coincides in the positive second main cutting angle $+\alpha_2$ with the second end point $E_2$. The version without removal of the residual material has the lowest nonproductive time of the three variants; however, a powerful drive motor 18 is required that can handle the greater depth of cut at the end point.

FIGS. 5A-N show a main cutting sequence with a first and second main cut. The number of main cuts depends inter alia on the final depth T of the separation cut, the material of workpiece 24 and the power of drive motor 18. The main cutting angle $\alpha_i$ and penetration depth $h_i$ of the individual main cuts can be specified by the operator, or control unit 29 of wall saw 12 calculates the main cutting angle or penetration depths for the individual main cuts from the boundary conditions of the separation cut.

FIGS. 6A-H show the wall saw system 10 with wall saw 12 when creating a further separation cut between a first end point $E_1$, which is a barrier, and a second end point $E_2$ that is defined as a free end point without barrier. Control of the wall saw 12 is done at the first end point $E_1$ through the first blade edge 61 (without blade guard 21) or the first blade guard edge 71 (with blade guard 21) and at the second end point $E_2$ through the second upper exit point 59 of the saw blade used.

The processing of the separation cut is done with the aid of the inventive method for controlling a wall saw system. The separation cut is done in a plurality of main cuts until the desired final depth T is reached.

The main cutting sequence comprises a first main cut having a first main cutting angle $\alpha_1$ of saw arm 17, a first diameter $D_1$ and a first penetration depth $h_1$ of the saw blade used, a second main cut with a second main cutting angle $\alpha_2$ of saw arm 17, a second diameter $D_2$ and a second, penetration depth $h_2$ of the blade used, and a third main cut with a third main cutting angle $\alpha_3$ of saw arm 17, a third diameter $D_3$ and a third penetration depth $h_3$ of the saw blade used.

The first main cut is performed in the embodiment with a first saw blade 16.1 and a first blade guard 21.1, wherein the first saw blade 16. 1 has a first saw blade diameter D.1 and the first blade guard a first blade guard width B.1. The first diameter $D_1$ of the first main, out matches the first saw blade diameter D.1 of the first saw blade 16.1, and the first width $B_1$ of the first main cut matches the first blade guard width B.1 of the first blade guard 2.1.1.

The second main cut and the third main cut are done in the embodiment with a second saw blade 16.2 and a second blade guard 21.2. The second saw blade 16.2 has a second saw blade diameter D.2 and the second blade guard 21.2 a second blade guard width B.2. The second diameter $D_2$ of the second main cut and the third diameter $D_3$ of the third main cut match the second saw blade diameter D.2 of the second saw blade 16.2, and the second width $B_2$ of the second main cut and the third width $B_3$ of the third main cut match the second blade guard width B.2 of the second blade guard 21.2.

Figure 6A:
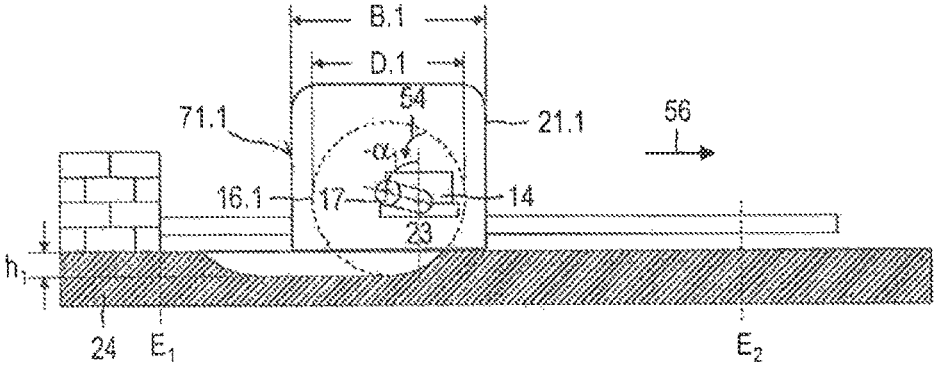
FIGS. 6A-H illustrate the wall saw of FIG. 1 in creating a further separation cut between a barrier and a free end point without barrier with the help of the inventive method.

The processing of the separation cut starts at the first end point $E_1$. Since the first blade guard 21.1 is mounted, control of the wall saw 12 is effected at the first end point $E_1$ through the first blade guard edge 71.1 of the first blade guard 21.1. After the start of the inventive method the saw head 14 is positioned in a starting position in which the pivot axis 23 has a distance of $B_1/2-\delta\cdot\sin(-\alpha_1)$ to the first end point $E_1$. In the starting position the saw arm 17 is rotated from the basic position 0° in the negative rotational direction 54 in the negative first main cutting angle $-\alpha_1$ and saw head 14 is moved with saw arm inclined at $-\alpha_1$ in the positive feed direction 56 (FIG. 6A).

The saw head 14 is moved in the positive feed direction 56 until pivot axis 23 has a distance of $\sqrt{[h_1\cdot(D_1-h_{1)}]}+\delta\cdot\sin(+\alpha_{1)}$ to the second end point $E_2$, where $h_1=h(+\alpha_1, D_{1)}=D_1/2-\Delta-\delta\cdot\cos(+\alpha_1)$ denotes the penetration depth of the first saw blade 16.1 into workpiece 24 at the positive first main cutting angle $+\alpha_1$ with the first diameter $D_1$, corresponding to the first saw blade diameter D.1. Then saw arm 17 is pivoted in the positive rotational direction 55 in the positive first main cutting angle $+\alpha_1$ and the residual material removed.

Figure 6B:
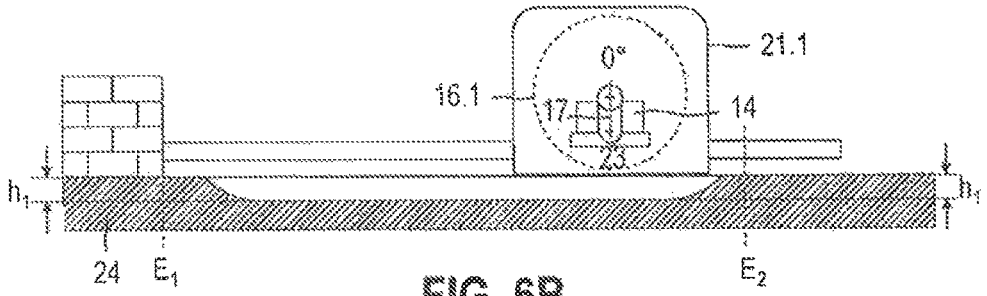

To change the saw blade from the first saw blade 16.1 to the second saw blade 16.2 the saw head 14 is positioned in a parking position and saw arm 17 is pivoted to the base position of 0° (FIG. 6B). The parking position is selected such that a swiveling and removing of the first saw blade 16.1 and first blade guard 21.1 and a mounting and pivoting of the second saw blade 16.2 and second blade guard 21.2 are possible. Moreover, the path of saw head 14 for the second main cut should be as short as possible; ideally, the parking position corresponds to the starting position for the second main cut.

Figure 6C:
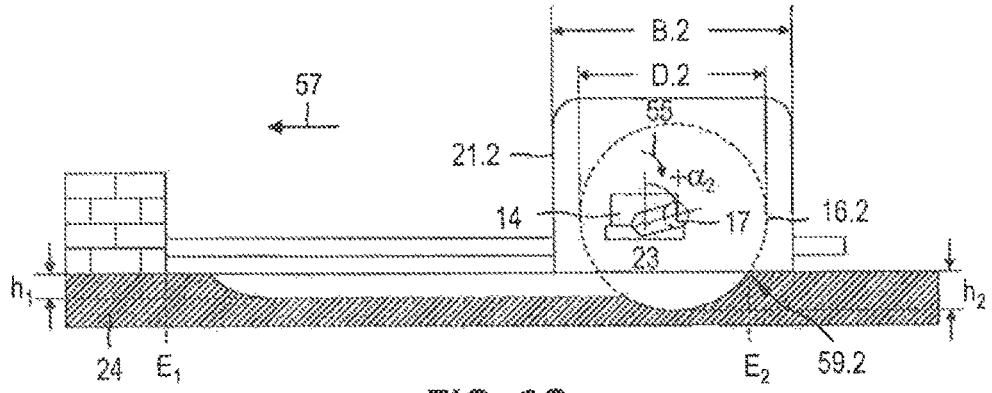
Figure 6D:
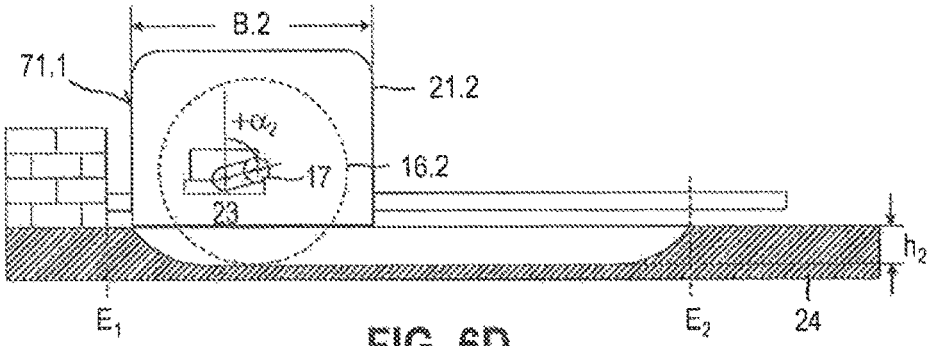

Since the second, end point $E_2$ is a free end point without barrier, the dismantling of the first saw blade 16.1 and first blade guard 21.1 and assembly of the second saw blade 16.2 and second blade guard 21.2 are easily possible. In the parking position, the pivot axis has a distance of $\sqrt{[h_2\cdot(D_2-h_2)]}+\delta\cdot\sin(+\alpha_2)$ to the second end point $E_2$, where $h_2=h(+\alpha_2, D_2)=D_2/2-\Delta-\delta\cdot\cos(+\alpha_2)$ denotes the penetration depth of the saw blade 16.2 into the workpiece 24 at the positive second main cutting angle $+\alpha_2$ with the second diameter $D_2$ corresponding to the second saw blade diameter D.2. The distance was set in the parking position so that second upper exit point 59.2 of second blade 16.2 facing the second end $E_2$ after the pivotal movement of saw arm $+\alpha_2$ in the positive second main cutting angle 17 matches the second end $E_2$ (FIG. 6C).

After mounting the second saw blade 16.2 and second blade guard 21.2 and resuming the controlled processing the wall saw 12 is positioned in the park position. The saw head 14 is moved with the saw arm 17 inclined at the positive second main cutting angle $+\alpha_2$ and the rotating second saw blade 16.2 in the negative feed direction 57. The transition from the second main cut to the third main cut is done by a complete removal of the residual material (FIG. 6D) or alternatively by a partial removal of the residual material or without removal. The control of the wall saw is done by the first blade guard edge 71.2 of the second blade guard 21.2.

Figure 6E:
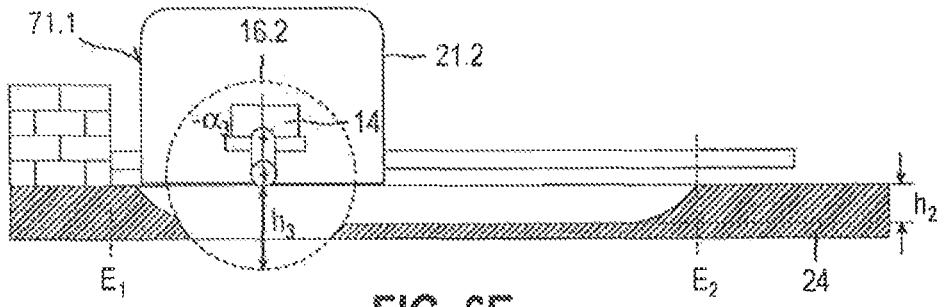
Figure 6F:
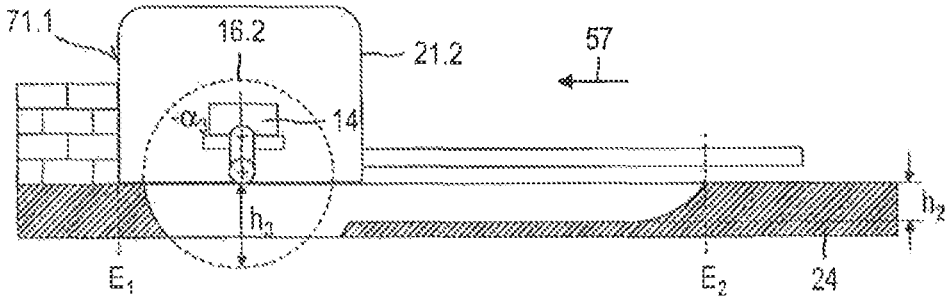
Figure 6G:
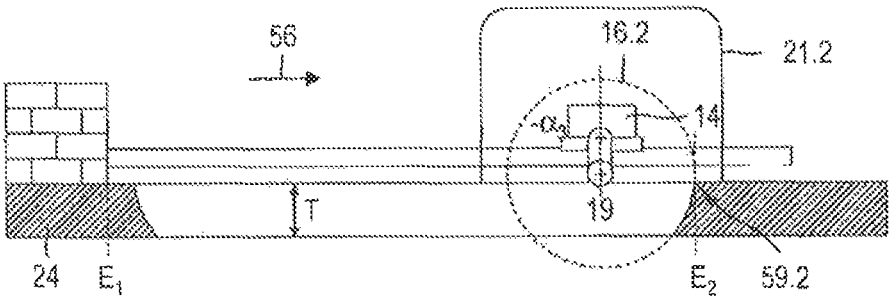
Figure 6H:
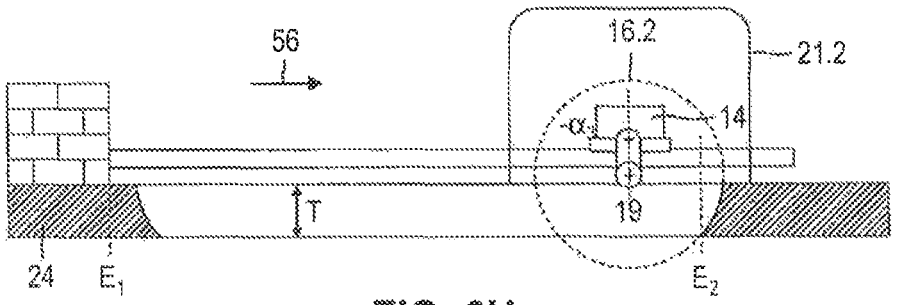

The positioning of saw head 14 for the third main cut with a main cutting angle of $-\alpha_3-180°$ occurs by means of the critical angle $\alpha_{crit}$ of −90°. The pivot axis 23 has a distance of $B.2/2-\delta\cdot\sin(-90°)=B.2/2+\delta$ to the first end point $E_1$. Then saw arm 17 is pivoted to the negative third main cutting angle of $-\alpha_3=-180°$ (FIG. 6E). Since the third main cut is the last main cut of the main cutting sequence, before the processing of the last main cut a corner processing of the first end point $E_1$ is done. For this purpose, saw head 14 with saw arm 17 inclined at $-\alpha_3=-180°$ FIG. 6F) is moved in the negative feed direction 57 until the first blade guard edge 71.2 of the second blade guard 21.2 coincides with the first end point $E_1$. The corner processing of the first end point $E_1$ can be improved when the second blade guard 21.2 is dismantled and the corner processing takes place without blade guard. Without blade guard the saw head 14 with saw arm 17 inclined at $-\alpha_3=-180°$ is moved in the negative feed direction 57 until the first saw blade edge 61.2 of the second blade 16.2 coincides with the first end point $E_1$.

The third main cut is made with the saw arm 17 inclined at the negative third main cutting angle $-\alpha_3$ in the positive feed direction 56. The feed movement of saw head 14 is stopped when the pivot axis 23 has a distance of $\sqrt{[h_3\cdot(D_3-h_3)]}+\delta\cdot\sin(180°)=\sqrt{[h_3\cdot(D_3-h_3]}$ to second end point $E_2$, where $h_3=h(-\alpha_3\ D_3)=D_3/2-\Delta-\delta\cdot\cos(-180°)=D_3/2-\Delta+\delta$ denotes the penetration depth of the saw blade into workpiece 24 at the negative third main cutting angle $-\alpha_3--180°$ with the third diameter $D_3$, which corresponds to the second saw blade diameter D.2. When at the second end point $E_2$ an overcut is allowed, after the last main cut a corner processing of the second end point $E_2$ (FIG. 6H) is done.

For the separation cuts shown in FIGS. 5A-N and FIGS. 6A-H the pivotal movement of saw arm 17 in a main cutting angle occurs in a pivotal movement. With hard materials or less powerful drive motors 18, for saw blade 16 it may be advantageous to carry out the pivotal movement of saw arm 17 in at least two steps with an intermediate angle, with a clean cut of saw blade 16 between the pivoting movements in the intermediate angle.

The invention claimed is:

1. A method for controlling a wall saw system, wherein the wall saw system comprises a guide rail and a wall saw with a saw head, a motor-driven feed unit that moves the saw head parallel to a feed direction along the guide rail, at least one saw blade fastened to a saw arm of the saw head, the saw arm pivotable around a pivot axis and the at least one saw blade driven around an axis of rotation, and at least one detachable blade guard surrounding the saw blade;

and comprising the steps of:

creating a separation cut of a final depth (T) in a workpiece of a workpiece thickness (d) between a first end point ($E_1$) and a second end point ($E_2$);

wherein, before a start of a processing of the separation cut controlled by a control unit of the wall saw, at least a saw blade diameter (D) of the saw blade, positions of the first and the second end points in the feed direction, the final depth (T) of the separation cut, and a main cutting sequence of m main cuts with $m \geq 2$ are determined;

wherein the m main cuts of the main cutting sequence comprise at least a first main cut with a first main cutting angle ($\alpha_1$) of the saw arm and a first diameter ($D_1$) of a saw blade used in the first main cut and a subsequent second main cut with a second main cutting angle ($\alpha_2$) of the saw arm and a second diameter ($D_2$) of a saw blade used in the second main cut;

wherein during the processing controlled by the control unit:

the saw arm is pivoted about the pivot axis in a negative rotational direction and arranged at a negative first main cutting angle ($-\alpha_1$) calculated from a basic position of the saw arm;

the saw head is moved in a positive feed direction in a direction of the second end point ($E_2$), wherein the saw arm is arranged in a pulling arrangement; and the saw arm is pivoted about the pivot axis in a positive rotational direction counter to the negative rotational direction from the negative first main cutting angle ($-\alpha_1$) into a new pivot angle ($+\alpha_1$, $+\alpha_s$) calculated from the basic position of the saw arm;

wherein the saw head in the controlled processing is moved such that after pivoting movement of the saw arm in the new pivot angle ($+\alpha_1$, $+\alpha_s$) a second limit of the wall saw facing the second end point ($E_2$) coincides with the second end point ($E_2$);

wherein the second limit of the wall saw is formed by a second upper exit point of the saw blade used, facing the second end point ($E_2$), at an upper side of the workpiece, if the second end point ($E_2$) is a free end point without a barrier, by a second saw blade edge of the saw blade used, facing the second end point ($E_2$), if the second end point ($E_2$) is a barrier and the processing is done without the blade guard, and by a second blade guard edge of the blade guard used, facing the second end point ($E_2$), if the second end point ($E_2$) is a barrier and the processing occurs with the blade guard.

2. The method according to claim 1, wherein before the start of the processing, additionally a saw arm length ($\delta$) of the saw arm is determined, defined as a distance between the pivot axis and the axis of rotation, and a distance ($\Delta$) between the pivot axis and the upper side of the workpiece.

3. The method according to claim 2, wherein before the start of the processing, additionally a first width ($B_1$) for a blade guard used in the first main cut and a second width ($B_2$) for a blade guard used in the second main cut are determined, wherein the first and second widths ($B_1$, $B_2$) are each compiled of a first distance ($B_{1a}$, $B_{2a}$) of the axis of rotation to a first blade guard edge and a second distance ($B_{1b}$, $B_{2b}$) of the axis of rotation to the second blade guard edge.

4. The method according to claim 2, wherein the saw arm in the positive rotational direction is pivoted out of the negative first main cutting angle ($-\alpha_1$) in the positive first main cutting angle ($+\alpha_1$) and after the pivoting movement into the positive first main cutting angle ($+\alpha_1$) the second upper exit point of the saw blade used coincides with the second end point ($E_2$) if the pivot axis has a distance to the second end point ($E_2$) of $\sqrt{[h_1 \cdot (D_1 - h_1)]} + \delta \cdot \sin(+\alpha_1)$, where $h_1 = h(+\alpha_1, D_1) = D_1/2 - \Delta - \delta \cos(+\alpha_1)$ denotes a penetration depth of the saw blade used into the workpiece with the positive first main cutting angle ($+\alpha_1$) with the first diameter ($D_1$), the second saw blade edge of the saw blade used coincides with the second end point ($E_1$) if the pivot axis has a distance to the second end point ($E_2$) of $D_1/2 + \delta \sin(+\alpha_1)$, and the second blade guard edge of the blade guard used coincides with the second end point ($E_2$) if the pivot axis has a distance to the second end point ($E_2$) of $B_{1b} + \delta \cdot \sin(+\alpha_1)$.

5. The method according to claim 4, wherein the saw head is moved in a negative feed direction counter to the positive feed direction by a path length of at least $2\delta|\sin(+\alpha_1)|$ and the saw head is then positioned such that the second limit of the wall saw after the pivoting movement of the saw arm into the positive second main cutting angle ($+\alpha_1$) coincides with the second end point ($E_2$), wherein the second upper exit point of the saw blade used coincides with the second end point ($E_2$) if the pivot axis has a distance to the second end point ($E_2$) of $\sqrt{[h_2 \cdot (D_2 - h_2)]} + \delta \cdot \sin(+\alpha_2)$, where $h_2 = h(+\alpha_2, D_2) = D_2/2 - \Delta - \delta \cdot \cos(+\alpha_2)$ denotes the penetration depth of the saw blade used into the workpiece with the positive second main cutting angle ($+\alpha_2$) with the second diameter ($D_2$), the second saw blade edge of the saw blade used coincides with the second end point ($E_2$) if the pivot axis has a distance to the second end point ($E_2$) of $D_2/2 + \delta \cdot \sin(+\alpha_2)$, and the second blade guard edge of the blade guard used coincides with the second end point ($E_2$) if the pivot axis has a distance to the second end point ($E_2$) of $B_{2b} + \delta \cdot \sin(+\alpha_2)$.

6. The method according to claim 4, wherein the saw head is moved in a negative feed direction such that the second limit of the wall saw after the pivoting movement of the saw arm into the positive second main cutting angle ($+\alpha_2$) coincides with the second end point ($E_2$), wherein the second upper exit point of the saw blade used coincides with the second end point ($E_2$) if the pivot axis has a distance to the second end point ($E_2$) of $\sqrt{[h_2 \cdot (D_2 - h_2)]} + \delta - \sin(+\alpha_2)$, where $h_2 = h(+\alpha_2, D_2) = D_2/2 - \Delta - \delta \cdot \cos(+\alpha_2)$ denotes the penetration depth of the saw blade used into the workpiece with the positive second main cutting angle ($+\alpha_2$) with the second diameter ($D_2$), the second saw blade edge of the saw blade used coincides with the second end point ($E_2$) if the pivot axis has a distance to the second end point ($E_2$) of $D_2/2 + \delta \cdot \sin(+\alpha_2)$, and the second blade guard edge of the blade guard used coincides with the second end point ($E_2$) if the pivot axis has a distance to the second end point ($E_2$) of $B_{2b} + \delta \cdot \sin(+\alpha_2)$.

7. The method according to claim 2, wherein the saw head in the positive rotational direction is rotated from the negative first main cutting angle ($-\alpha_1$) into the positive second main cutting angle ($+\alpha_2$) and after the pivoting movement into the positive second main cutting angle ($+\alpha_2$) the second upper exit point of the saw blade used coincides with the second end point ($E_2$), if the pivot axis has a distance to the second end point ($E_2$) of $I[h_2\cdot(D_2-h_2)]+\delta\cdot\sin(+\alpha_2)$, where $h_2=h(+\alpha_2, D_2)=D_2/2-\Delta-\delta\cdot\cos(+\alpha_2)$ denotes the penetration depth of the saw blade used into the workpiece with the positive second main cutting angle ($+\alpha_2$) with the second diameter ($D_2$), the second saw blade edge of the saw blade used coincides with the second end point ($E_2$), if the pivot axis has a distance to the second end point ($E_2$) of $D_2/2+\delta\cdot\sin(+\alpha_2)$, and the second blade guard edge of the blade guard used coincides with the second end point ($E_2$) if the pivot axis has a distance to the second end point ($E_2$) of $B_{2b}+\delta\cdot\sin(+\alpha_2)$.

8. The method according to claim 5, wherein the saw head with the saw arm inclined at the positive second main cutting angle ($+\alpha_2$) is moved in the negative feed direction.

9. The method according to claim 8, wherein the saw head in the processing is moved such that a first limit of the wall saw facing the first end point ($E_1$) after the pivoting movement of the saw arm from the positive second main cutting angle ($+\alpha_2$) into a new pivot angle ($-\alpha_2$, $-\alpha_3$) coincides with the first end point ($E_1$), wherein the first limit of the wall saw is formed by the first upper exit point of the saw blade used, facing the first end point ($E_1$), at the upper side of the workpiece, if the first end point ($E_1$) is a free end point without a barrier, by a first saw blade edge of the saw blade used, facing the first end point ($E_1$), if the first end point ($E_1$) is a barrier and the processing occurs without the blade guard, and by a first blade guard edge of the blade guard used, facing the first end point ($E_1$), if the first end point ($E_1$) is a barrier and the processing occurs with the blade guard.

10. The method according to claim 9, wherein the second main cut is a last main cut of the main cutting sequence, the saw arm is rotated in the negative rotational direction from the positive second main cutting angle ($+\alpha_2$) into the negative second main cutting angle ($-\alpha_2$) and after the pivoting movement into the negative second main cutting angle ($-\alpha_2$) the first upper exit point coincides with the first end point ($E_1$) if the pivot axis has a distance to the second end point ($E_1$) of $\sqrt{[h_2\cdot(D_2-h_2)]}-\delta\cdot\sin(-\alpha 2)$, where $h_2=h(-\alpha_2, D_2)=D_2/2-\Delta-\delta\cdot\cos(-\alpha 2)$ denotes the penetration depth of the saw blade used into the workpiece with the negative positive second main cutting angle ($-\alpha_2$) with the second diameter ($D_2$), the first saw blade edge of the saw blade used coincides with the first end point ($E_1$), if the pivot axis has a distance to the first end point ($E_1$) of $D_2/2-\delta\cdot\sin(-\alpha_2)$, and the first blade guard edge of the blade guard used coincides with the first end point ($E_1$) if the pivot axis has a distance to the first end point ($E_1$) of $B_{2a}+\delta\cdot\sin(-\alpha 2)$.

11. The method according to claim 10, wherein the saw head in the positive feed direction is moved with the saw arm inclined a second main cutting angle ($-\alpha_2$) by a path length of at least $2\delta|\sin(-\alpha_2)|$.

12. The method according to claim 9, wherein the main cutting sequence comprises a third main cut made after the second main cut with a third main cutting angle ($\alpha_3$) of the saw arm, a third diameter ($D_3$) of the saw blade used and a third width ($B_3$) of the blade guard used with the first and second distances ($B_{3a}$, $B_{3b}$) to the blade guard edges, wherein the blade arm in the third main cut is in a pulling arrangement and the saw head is moved in the positive feed direction.

13. The method according to claim 12, wherein the saw head in the negative feed direction is moved such that the first limit of the wall saw after the pivotal movement of the saw arm in the negative second main cutting angle ($-\alpha 2$) with the first end point ($E_1$) coincides with the first limit, wherein the first upper exit point of the saw blade used facing the first end point ($E_1$) at the upper side of the workpiece is formed if the first point ($E_1$) is a free end without barrier, by a first saw blade edge facing the first end point ($E_1$) of the saw blade used if the first end point ($E_1$) is a barrier, and the processing is done without blade guard, and a first blade guard edge facing the first end point ($E_1$) of the blade guard used if the first end point ($E_1$) is a barrier and the processing occurs with blade guard.

14. The method according to claim 13, wherein the saw head in the positive feed direction with the saw arm inclined at the negative second main cutting angle ($-\alpha_2$) is moved by a path length of at least $2\delta|\sin(-\alpha_2)|$, and the saw head is then positioned such that the first limit of the wall saw after the pivoting movement of the saw arm in a negative third main cutting angle ($-\alpha_3$) coincides with the first end point ($E_1$), wherein the first upper exit point of the saw blade used coincides with the first end point ($E_1$), if the pivot axis has a distance to the first end point ($E_1$) of $\sqrt{[h_3\cdot(D_3-h_3]}-\delta\cdot\sin(-\alpha_3)$, where $h_3=h(-\alpha_3, D_3)=D_3/2-\Delta-\delta\cdot\cos(-\alpha_3)$ denotes the penetration depth of the saw blade used into the workpiece with the negative third main cutting angle ($-\alpha_3$) with the third diameter ($D_3$), the first saw blade edge of the saw blade used coincides with the first end point ($E_1$), if the pivot axis has a distance to the first end point ($E_1$) of $D_3/2-\delta\cdot\sin(-\alpha_3)$, and the first blade guard edge of the blade guard used coincides with the first end point ($E_1$) if the pivot axis has a distance to the first end point ($E_1$) of $B_{3a}-\delta\cdot\sin(-\alpha_3)$.

15. The method according to claim 13, wherein the saw head in the positive feed direction is moved such that the first limit of the wall saw after the pivoting movement of the saw arm in a negative third main cutting angle ($-\alpha_3$) coincides with the first end point ($E_1$), wherein the first upper exit point of the saw blade used coincides with the first end point ($E_1$), if the pivot axis has a distance to the first end point ($E_1$) of $\sqrt{[h_3\cdot(D_3-h_3]}+\delta\cdot\sin(-\alpha_3)$, where $h_3=h(-\alpha_3, D_3)=D_3/2-\Delta-\delta\cdot\cos(-\alpha_3)$ denotes the penetration depth of the saw blade used into the workpiece with the negative third main cutting angle ($-\alpha_3$) with the third diameter ($D_3$), the first saw blade edge of the saw blade used coincides with the first end point ($E_1$), if the pivot axis has a distance to the first end point ($E_1$) of $D_3/2-\delta-\sin(-\alpha_3)$, and the first blade guard edge of the blade guard used coincides with the first end point ($E_1$) if the pivot axis has a distance to the first end point ($E_1$) of $B_{3a}-\delta\cdot\sin(-\alpha_3)$.

16. The method according to claim 12, wherein the saw head in the negative feed direction is pivoted from the positive second main cutting angle ($+\alpha_2$) in a negative third main cutting angle ($-\alpha_3$) and after the pivoting movement into the negative third main cutting angle ($-\alpha_3$) the first upper exit point of the saw blade used coincides with the first end point ($E_1$), if the pivot axis has a distance to the first end point ($E_1$) of $\sqrt{[h_3\cdot(D_3-h_3]}-\delta\cdot\sin(-\alpha_3)$, where $h_3=h(-\alpha_3, D_3)=D_3/2-\Delta-\delta\cdot\cos(-\alpha_3)$ denotes the penetration depth of the saw blade used into the workpiece with the negative third main cutting angle ($-\alpha_3$) with the third diameter ($D_3$), the first saw blade edge of the saw blade used coincides with the first end point ($E_1$), if the pivot axis has a distance to the first end point ($E_1$) of $D_3/2-\delta\cdot\sin(-\alpha_3)$, and the first blade guard edge of the blade guard used coincides with the first end point ($E_1$) if the pivot axis has a distance to the first end point ($E_1$) of $B_{3a}-\delta\cdot\sin(-\alpha_3)$.

17. The method according to claim 1, wherein the first and second main cuts are done with a saw blade and a blade guard.

18. The method according to claim 1, wherein the first main cut is done with a first saw blade and a first blade guard, wherein the first saw blade has a first saw blade diameter (D.1) and the first blade guard has a first blade guard width (B.1), and the second main cut is done with a second saw blade and a second blade guard, wherein the second saw blade has a second saw blade diameter (D.2) and the second blade guard has a second blade guard width (B.2).

19. The method according to claim 1, wherein the first main cut of the main cutting sequence is a precut and the saw head after the start of the processing is positioned in a start position ($X_{Start}$), wherein in the start position ($X_{Start}$) the first limit facing the first end point ($E_1$) of the wall saw after the pivoting movement in the negative first main cutting angle ($-\alpha_1$) coincides with the first end point ($E_1$).

20. The method according to claim 19, wherein the first upper exit point of the saw blade used coincides with the first end point ($E_1$) if the pivot axis has a distance to the first end point ($E_1$) of $\sqrt{[h_1\cdot(D_1-h_1]}-\delta\cdot\sin(-\alpha_1)$, where $h_1=h(-\alpha_1, D_1)=D_1/2-\Delta\cdot\cos(-\alpha_1)$ denotes the penetration depth of the saw blade used into the workpiece with the negative first main cutting angle ($-\alpha_1$) with the first diameter ($D_1$), the first saw blade edge of the saw blade used coincides with the first end point ($E_1$), if the pivot axis has a distance to the first end point ($E_1$) of $D_1/2-\delta\cdot\sin(-\alpha_1)$, and the first blade guard edge of the blade guard used coincides with the first end point ($E_1$) if the pivot axis has a distance to the first end point ($E_1$) of $B_{1a}-\delta\cdot\sin(-\alpha_1)$.

* * * * *